US007198347B2

(12) United States Patent
Tayuki

(10) Patent No.: US 7,198,347 B2
(45) Date of Patent: Apr. 3, 2007

(54) ADJUSTMENT OF SHIFT OF DOT POSITION OF PRINTER

(75) Inventor: Kazushige Tayuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 961 days.

(21) Appl. No.: 10/048,323

(22) PCT Filed: May 25, 2001

(86) PCT No.: PCT/JP01/04426

§ 371 (c)(1),
(2), (4) Date: Jan. 30, 2002

(87) PCT Pub. No.: WO01/92020

PCT Pub. Date: Dec. 6, 2001

(65) Prior Publication Data

US 2002/0113985 A1 Aug. 22, 2002

(30) Foreign Application Priority Data

May 30, 2000 (JP) ..... 2000-159422
May 30, 2000 (JP) ..... 2000-159432

(51) Int. Cl.
*B41J 29/393* (2006.01)

(52) U.S. Cl. ..... 347/19; 347/15

(58) Field of Classification Search ..... 347/15, 347/43, 19, 16; 358/1.09, 3.03, 3.06, 504
See application file for complete search history.

(56) References Cited

U.S. PATENT DOCUMENTS 5,289,294 A 2/1994 Fujisawa
6,164,745 A * 12/2000 Nagoshi et al. ..... 347/15
6,439,683 B1 * 8/2002 Matsumoto et al. ..... 347/15
6,464,319 B1 * 10/2002 Teshigawara et al. ..... 347/19
6,643,035 B1 * 11/2003 Salgado ..... 358/474
2002/0057459 A1 * 5/2002 Nagarajan et al. ..... 358/3.03

FOREIGN PATENT DOCUMENTS

| | | | |
|---|---|---|---|
| EP | 0 895 869 | A2 | 2/1999 |
| EP | 08 95869 | A2 | 2/1999 |
| EP | 0 953 452 | A2 | 11/1999 |
| EP | 09 53452 | A2 | 11/1999 |
| JP | 03-286680 | A | 12/1991 |
| JP | 08-088771 | | 4/1996 |
| JP | 8-88771 | B1 | 4/1996 |
| JP | 10-157087 | | 6/1998 |

(Continued)

*Primary Examiner*—Lamson Nguyen
(74) *Attorney, Agent, or Firm*—Sughrue Mion, PLLC

(57) ABSTRACT

The object of the present invention is to adjust relative misalignment of recording positions of dots created at different timings with high accuracy, thereby enhancing the printing quality.

A patch pattern is used as a test pattern for adjusting misalignment of recording positions between a first dot and a second dot created at different timings. In the test pattern, a fraction of the first dot and the second dot adjoining to each other in either a main scanning direction or a sub-scanning direction may be significantly greater than a fraction of the first dots or the second dots adjoining to each other. In the test pattern, substantially equal numbers of the first dot and the second dot may be created with a substantially equivalent dispersibility over a practically whole area.

18 Claims, 34 Drawing Sheets

FOREIGN PATENT DOCUMENTS

| | | | |
|---|---|---|---|
| JP | 10-157087 | B1 | 6/1998 |
| JP | 11-048587 | A | 2/1999 |
| JP | 11-177823 | | 7/1999 |
| JP | 11-177823 | B1 | 7/1999 |
| JP | 11-192693 | | 7/1999 |
| JP | 11-291470 | | 10/1999 |
| JP | 2000-37936 | B1 | 2/2000 |
| JP | 2000-037937 | A | 2/2000 |

* cited by examiner

Fig. 8

Nozzle Pitch k : 6
Number of Working Nozzles N : 47
Number of Scans s : 2
Number of Effective Nozzles Neff : 47/2

| Pass No. | 1 | 2 | 3 | 4 | 5 | 6 | 7 | 8 | 9 | 10 | 11 | 12 | 13 |
|---|---|---|---|---|---|---|---|---|---|---|---|---|---|
| Feed L | 0 | 21 | 26 | 21 | 26 | 21 | 26 | 21 | 26 | 21 | 26 | 21 | 26 |
| ΣL | 0 | 21 | 47 | 68 | 94 | 115 | 141 | 162 | 188 | 209 | 235 | 256 | 282 |
| F=(ΣL)%k | 0 | 3 | 5 | 2 | 4 | 1 | 3 | 0 | 2 | 5 | 1 | 4 | 0 |
| Horizontal Position | 1 | 2 | 1 | 2 | 1 | 2 | 1 | 2 | 1 | 2 | 1 | 2 | 1 |

Raster Number

| | | | | | | | | | | | | | |
|---|---|---|---|---|---|---|---|---|---|---|---|---|---|
| 1 | | | 35 | | | | | | | 8 | | | |
| 2 | 43 | | | | | | | 16 | | | | | |
| 3 | | | | | | 24 | | | | | 4 | | |
| 4 | | | | 32 | | | | | 12 | | | | |
| 5 | | 40 | | | | | 20 | | | | | | |
| 6 | | | | | 28 | | | | | | | 1 | |
| 7 | | | 36 | | | | | | | 9 | | | |
| 8 | 44 | | | | | | | 17 | | | | | |
| 9 | | | | | | 25 | | | | | 5 | | |
| 10 | | | | 33 | | | | | 13 | | | | |
| 11 | | 41 | | | | | 21 | | | | | | |
| 12 | | | | | 29 | | | | | | | 2 | |
| 13 | | | 37 | | | | | | | 10 | | | |
| 14 | 45 | | | | | | | 18 | | | | | |
| 15 | | | | | | 26 | | | | | 6 | | |
| 16 | | | | 34 | | | | | 14 | | | | |
| 17 | | 42 | | | | | 22 | | | | | | |
| 18 | | | | | 30 | | | | | | | 3 | |
| 19 | | | 38 | | | | | | | 11 | | | |
| 20 | 46 | | | | | | | 19 | | | | | |
| 21 | | | | | | 27 | | | | | 7 | | |
| 22 | | | | 35 | | | | | 15 | | | | |
| 23 | | 43 | | | | | 23 | | | | | | |
| 24 | | | | | 31 | | | | | | | 4 | |
| 25 | | | 39 | | | | | | | 12 | | | |
| 26 | 47 | | | | | | | 20 | | | | | |
| 27 | | | | | | 28 | | | | | 8 | | |
| 28 | | | | 36 | | | | | 16 | | | | |
| 29 | | 44 | | | | | 24 | | | | | | |
| 30 | | | | | 32 | | | | | | | 5 | |
| 31 | | | 40 | | | | | | | 13 | | | |
| 32 | | | | | | | | 21 | | | | | 1 |
| 33 | | | | | | 29 | | | | | 9 | | |
| 34 | | | | 37 | | | | | 17 | | | | |
| 35 | | 45 | | | | | 25 | | | | | | |
| 36 | | | | | 33 | | | | | | | 6 | |
| 37 | | | 41 | | | | | | | 14 | | | |
| 38 | | | | | | | | 22 | | | | | 2 |

Horizontal Position

| 1 | 2 |
|---|---|
| 1 | 8 |
| 11 | 6 |
| 9 | 4 |
| 7 | 2 |
| 5 | 12 |
| 3 | 10 |

Fi. g10

Nozzle Pitch k : 6
Number of Working Nozzles N : 48
Number of Scans s : 2
Number of Effective Nozzles Neff : 24

| Pass No. | 1 | 2 | 3 | 4 | 5 | 6 | 7 | 8 | 9 | 10 | 11 | 12 | 13 |
|---|---|---|---|---|---|---|---|---|---|---|---|---|---|
| Feed L | 0 | 20 | 27 | 22 | 28 | 21 | 26 | 20 | 27 | 22 | 28 | 21 | 26 |
| ΣL | 0 | 20 | 47 | 69 | 97 | 118 | 144 | 164 | 191 | 213 | 241 | 262 | 288 |
| F=(ΣL) | 0 | 2 | 5 | 3 | 1 | 4 | 0 | 2 | 5 | 3 | 1 | 4 | 0 |
| Horizontal Position | 1 | 2 | 1 | 2 | 1 | 2 | 2 | 1 | 2 | 1 | 2 | 1 | 1 |

Horizontal Position

| 1 | 2 |
|---|---|
| 1 | 7 |
| 5 | 11 |
| 8 | 2 |
| 10 | 4 |
| 12 | 6 |
| 3 | 9 |

| Raster Number | | | | | | | | | | | | | |
|---|---|---|---|---|---|---|---|---|---|---|---|---|---|
| 1 | | | 36 | | | | | | 12 | | | | |
| 2 | 44 | | | | | | 20 | | | | | | |
| 3 | | | | | 28 | | | | | | 4 | | |
| 4 | | 41 | | | | | | 17 | | | | | |
| 5 | | | | 33 | | | | | | 9 | | | |
| 6 | | | | | | 25 | | | | | | 1 | |
| 7 | | | 37 | | | | | | 13 | | | | |
| 8 | 45 | | | | | | 21 | | | | | | |
| 9 | | | | | 29 | | | | | | 5 | | |
| 10 | | 42 | | | | | | 18 | | | | | |
| 11 | | | | 34 | | | | | | 10 | | | |
| 12 | | | | | | 26 | | | | | | 2 | |
| 13 | | | 38 | | | | | | 14 | | | | |
| 14 | 46 | | | | | | 22 | | | | | | |
| 15 | | | | | 30 | | | | | | 6 | | |
| 16 | | 43 | | | | | | 19 | | | | | |
| 17 | | | | 35 | | | | | | 11 | | | |
| 18 | | | | | | 27 | | | | | | 3 | |
| 19 | | | 39 | | | | | | 15 | | | | |
| 20 | 47 | | | | | | 23 | | | | | | |
| 21 | | | | | 31 | | | | | | 7 | | |
| 22 | | 44 | | | | | | 20 | | | | | |
| 23 | | | | 36 | | | | | | 12 | | | |
| 24 | | | | | | 28 | | | | | | 4 | |
| 25 | | | 40 | | | | | | 16 | | | | |
| 26 | 48 | | | | | | 24 | | | | | | |
| 27 | | | | | 32 | | | | | | 8 | | |
| 28 | | 45 | | | | | | 21 | | | | | |
| 29 | | | | 37 | | | | | | 13 | | | |
| 30 | | | | | | 29 | | | | | | 5 | |
| 31 | | | 41 | | | | | | 17 | | | | |
| 32 | | | | | | | 25 | | | | | | 1 |
| 33 | | | | | 33 | | | | | | 9 | | |
| 34 | | 46 | | | | | | 22 | | | | | |
| 35 | | | | 38 | | | | | | 14 | | | |
| 36 | | | | | | 30 | | | | | | 6 | |
| 37 | | | 42 | | | | | | 18 | | | | |
| 38 | | | | | | | 26 | | | | | | 2 |

Fig. 12

Nozzle Pitch k : 6
Number of Working Nozzles N : 47
Number of Scans s : 2
Number of Effective Nozzles Neff : 47/2

| Pass No. | 1 | 2 | 3 | 4 | 5 | 6 | 7 | 8 | 9 | 10 | 11 | 12 | 13 |
|---|---|---|---|---|---|---|---|---|---|---|---|---|---|
| Feed L | 0 | 21 | 26 | 21 | 26 | 21 | 26 | 21 | 26 | 21 | 26 | 21 | 26 |
| ΣL | 0 | 21 | 47 | 68 | 94 | 115 | 141 | 162 | 188 | 209 | 235 | 256 | 282 |
| F=(ΣL) | 0 | 3 | 5 | 2 | 4 | 1 | 3 | 0 | 2 | 5 | 1 | 4 | 0 |
| Horizontal Position | 1 | 1 | 2 | 2 | 1 | 1 | 2 | 2 | 1 | 1 | 2 | 2 | 1 |

| Raster Number | | |

Fig. 26

Nozzle Pitch k : 6
Numer of Working Nozzles N : 46
Number of Scans s : 4
Number of Effective Nozzles Neff : 46/4

| Pass No. | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| Feed L | 0 | 9 | 14 | 9 | 14 | 9 | 14 | 9 | 14 | 9 | 14 | 9 | 14 | 9 | 14 | 9 | 14 | 9 | 14 | 9 | 14 | 9 | 14 | 9 | 14 |
| ΣL | 0 | 9 | 23 | 32 | 46 | 55 | 69 | 78 | 92 | 101 | 115 | 124 | 138 | 147 | 161 | 170 | 184 | 193 | 207 | 216 | 230 | 239 | 253 | 262 | 276 |
| F=(ΣL) | 0 | 3 | 5 | 2 | 4 | 1 | 3 | 0 | 2 | 5 | 1 | 4 | 0 | 3 | 5 | 2 | 4 | 1 | 3 | 0 | 2 | 5 | 1 | 4 | 0 |
| Horizontal Position | 1 | 1 | 2 | 2 | 3 | 3 | 4 | 4 | 1 | 1 | 2 | 2 | 3 | 3 | 4 | 4 | 1 | 1 | 2 | 2 | 3 | 3 | 4 | 4 | 1 |

| Horizontal Position | 1 | 2 | 3 | 4 |
|---|---|---|---|---|
| | 1 | 20 | 13 | 8 |
| | 18 | 11 | 6 | 23 |
| | 9 | 4 | 21 | 16 |
| | 2 | 19 | 14 | 7 |
| | 17 | 12 | 5 | 24 |
| | 10 | 3 | 22 | 15 |

| Raster Number | | | | | | | | | | | | | | | | | | | | | | | | | |
|---|---|---|---|---|---|---|---|---|---|---|---|---|---|---|---|---|---|---|---|---|---|---|---|---|---|
| 1 | | | | | | | | | | 27 | | | | | | | | | | | | | | | |
| 2 | 44 | | | | | | | 31 | | | | | 21 | | | | | | | | | | | | |
| 3 | | | | | | 35 | | | | | 25 | | | | | | | 12 | | | | | | | |
| 4 | | | | | | | 29 | | | | | | | | | 16 | | | | 10 | | | | | |
| 5 | | 43 | | | | | | | | | | | | 20 | | | | | | | | | | | |
| 6 | | | 37 | | | | | | | 28 | | 24 | | | 18 | | 14 | | | | 6 | 5 | | | |
| 7 | | | 41 | | | | | | | | | | 22 | | | | | | | 9 | | | | | |
| 8 | 45 | | | | | | | 32 | | | 26 | | | | | | | 13 | | | | | 3 | | |
| 9 | | | | | 36 | | | | | | | | | | | 17 | | | | | 7 | | | | |
| 10 | | | | 40 | | | 30 | | | | | | | 21 | | | 11 | | | | | | | | |
| 11 | 44 | | | | | | | | | | 34 | | | | | | | | | | | | | | |
| 12 | | | 38 | | | | | | | 29 | | 25 | | | 19 | | 15 | | | | | 6 | | 2 | |
| 13 | | 42 | | | | | | | | | | | 23 | | | | | | | 10 | | | | | |
| 14 | 46 | | | | | | | 33 | | | | | | | | | | 14 | | | | | 4 | | |
| 15 | | | | | 37 | | | | | | 27 | | | | | | | | | | 8 | | | | |
| 16 | | 41 | | | | | 31 | | | | | | | | | 18 | | | 12 | | | | | | |
| 17 | 45 | | | | | 35 | | | | | | 26 | | 22 | | | 16 | | | | | | 3 | | |
| 18 | | | 39 | | | | | | | 30 | | | | | 20 | | | | | | | 7 | | | |
| 19 | 43 | | | | | | | | | | | | 24 | | | | | | | 11 | | | | | 1 |
| 20 | | | | | | | | 34 | | | | | | | | | | | | | | | | | |

①Derr=-63.5

②Derr=32.25

③Derr=0

Fig. 29

| | 1 | 2 | 3 | 4 | 5 | 6 | 7 |
|---|---|---|---|---|---|---|---|
| Data | 128 | 128 | 128 | 128 | 128 | 128 | 128 |
| Data_X | 128 | 64.5 | 160.25 | 80.625 | 168.3125 | 84.65625 | 170.3281 |
| Thr | 85 | 85 | 85 | 85 | 85 | 85 | 85 |
| Result | 255 | 0 | 255 | 0 | 255 | 0 | 255 |
| Err | −127 | 64.5 | −94.75 | 80.625 | −86.6875 | 84.65625 | −84.6719 |

| 8 | 9 | 10 | 11 | 12 | 13 | 14 |
|---|---|---|---|---|---|---|
| 128 | 128 | 128 | 128 | 128 | 128 | 128 |
| 85.66406 | 43.33203 | 149.666 | 75.33301 | 165.6665 | 83.33325 | 169.6666 |
| 85 | 85 | 85 | 85 | 85 | 85 | 85 |
| 255 | 0 | 255 | 0 | 255 | 0 | 255 |
| −169.336 | 43.33203 | −105.334 | 75.33301 | −89.3335 | 83.33325 | −85.3334 |

Fig. 30

| | | | | | | |
|---|---|---|---|---|---|---|
| | | * | 1 | 0 | 1 | |
| 1 | 0 | 1 | 0 | | | |

Fig. 31

| | | | | | | | | | |
|---|---|---|---|---|---|---|---|---|---|
| | | | | * | 12 | −2 | 2 | 0 | 1 |
| 1 | 0 | 2 | −2 | 12 | 0 | | | | |

Fig. 32

| | | | | | | | | | |
|---|---|---|---|---|---|---|---|---|---|
| | | | | * | 4 | 2 | 2 | 0 | 1 |
| 1 | 0 | 2 | 2 | 4 | −2 | | | | |

Fig. 33

| | | | | |
|---|---|---|---|---|
| | | * | 4 | 2 |
| 1 | 2 | 4 | 2 | 1 |

ADJUSTMENT OF SHIFT OF DOT POSITION OF PRINTER

TECHNICAL FIELD

The present invention relates to adjustment of positional misalignment of dots created at different timings in a printing apparatus.

BACKGROUND ART

Ink jet printers have widely been used as the output apparatus of the computer. The ink jet printer ejects inks of various colors from multiple nozzles provided on a print head and creates dots on a printing medium, so as to implement printing. Bidirectional printing, that is, the technique of creating dots in both forward and backward passes of main scan, is known to enhance the printing speed in the ink jet printer.

In the ink jet printer, the ink ejection timing is adjusted with regard to respective nozzles, in order to create dots at predetermined positions. In the case of bidirectional printing, the ink ejection timing is adjusted according to the direction of main scan, such that the position of dots created in a forward pass of the main scan (hereinafter referred to as the forward dots) is coincident with the position of dots created in a backward pass of the main scan (hereinafter referred to as the backward dots). A test pattern is generally printed for the purpose of such adjustment.

FIG. 46 shows a prior art test pattern. This test pattern is used to adjust the positional misalignment of the forward dot and the backward dot in bidirectional printing. Each test pattern consists of a vertical line with the forward dots (the upper line) and a vertical line with the backward dots (the lower line). These lines are printed to partly overlap each other.

The backward dots are printed by shifting the drive timing stepwise in the order of Nos. 1, 2, 3, . . . In the conditions of Nos. 1 and 2, the drive timing of the backward dot is earlier than the adequate timing, and the position of the backward dot is deviated rightward from the position of the forward dot. In the conditions of Nos. 4 to 7, on the other hand, the drive timing of the backward dot is behind the adequate timing, and the position of the backward dot is deviated leftward from the position of the forward dot. The condition of No. 3 is the optimum drive timing, in which the position of the forward dot is practically coincident with the position of the backward dot. The user selects the condition No. 3 to adjust the drive timing of the dot.

In the specification hereof, the terms 'ink ejection timing' 'drive timing of the dot', and 'drive timing of the print head' are synonymous.

The recent trend in the ink jet printer reduces the size of dots for the enhanced picture quality. With this trend, even a little misalignment of dot positions significantly affects the picture quality.

In bidirectional printing, the positional misalignment of dots significantly affects the picture quality. For example, the delay of the drive timing of the dot deviates the recording position of the forward dot leftward, while deviating the recording position of the backward dot rightward. The positional misalignment of dots in bidirectional printing is accordingly double the misalignment in unidirectional printing and remarkably damages the picture quality.

It is, however, difficult to detect the little positional misalignment in the prior art vertical line test pattern. This results in insufficient accuracy of adjustment of the dot recording position. Namely the prior art technique can not satisfy the accuracy of adjustment required in the arrangement of the reduced dot size and bidirectional printing. This problem is not restricted to the forward dot and the backward dot, but is commonly found for any dots created by the print head.

DISCLOSURE OF THE INVENTION

The object of the present invention is thus to enhance accuracy in adjustment of positional misalignment of dots created at different timings in a printing apparatus.

In order to attain at least part of the above and the other related objects, the present invention is directed to a first print control apparatus that supplies print data to a printing device, which creates dots and thereby carries out printing. The printing device includes: a print head having multiple nozzles, from which ink is ejected; a scanning module that carries out main scan and sub-scan of the print head; and a driving module that drives the print head during each scan and causes at least two different types of dots, a first dot and a second dot, to be created at different timings in respective pixels. The print control apparatus has a test pattern data generation module that generates test pattern data used for printing a predetermined test pattern. The test pattern is a patch pattern, in which dots are created at a preset recording rate in a predetermined area and a fraction of the first dot and the second dot adjoining to each other in either of a main scanning direction and a sub-scanning direction is significantly greater than a fraction of the first dots or the second dots adjoining to each other.

The test pattern used in the present invention is a patch pattern, in which dots are created at a preset recording rate in a predetermined area. Misalignment of dot recording positions in the patch pattern typically causes significant rough touch. This arrangement thus facilitates detection of the positional misalignment.

The expression 'at a preset recording rate in a predetermined area' is not restricted to creation of dots at a fixed recording rate in a predetermined area. The recording rate may thus be varied stepwise in the patch of the test pattern, or may be varied gradually (gradation).

In the test pattern used in the present invention, the fraction of the first dot and the second dot adjoining to each other in either the main scanning direction or the sub-scanning direction is significantly greater than the fraction of the first dots or the second dots adjoining to each other. The inventors of the present invention have found that the adjoining arrangement of the first dot and the second dot makes the rough touch due to the positional misalignment more conspicuous. In the test pattern of the present invention, the positional misalignment of dots significantly increases the areas of the rough touch. This arrangement thus facilitates detection of the positional misalignment.

The arrangement of the present invention thus enables the dot recording positions to be adjusted with high accuracy, thus enhancing the printing quality.

In the print control apparatus of the present invention, the first dot and the second dot may be created with nozzles having different positions in the main scanning direction. Inks ejected from the nozzles having the different positions in the main scanning direction may be an identical color or different hues.

When dots are to be formed at an identical positions with inks ejected from the nozzles having the different positions in the main scanning direction, the ink ejection timing should be adjusted according to the main scan rate of the print head. Application of the technique of the present invention enables the dot recording positions to be adjusted with high accuracy.

In accordance with one preferable application of the print control apparatus of the present invention, the first dot is a forward dot created in a forward pass of the main scan of the print head, and the second dot is a backward dot created in a backward pass of the main scan of the print head.

Even a slight relative misalignment of recording positions of the forward dot and the backward dot significantly affects the printing quality in bidirectional printing, compared with unidirectional printing that records dots only in the forward pass of the main scan. This arrangement enables the recording positions of the forward dot and the backward dot to be adjusted with high accuracy, thus effectively improving the printing quality.

In the print control apparatus of the present invention, the test pattern may include the first dot and the second dot arranged checkerwise.

The test pattern having the first dots and the second dots arranged checkerwise facilitates detection of granularity due to positional misalignment of dots.

In the print control apparatus of the present invention, it is preferable that the preset recording rate in the test pattern corresponds to an intermediate tone.

The intermediate tone, that is, a medium tone in a tone range reproducible by the printing apparatus significantly affects the printing quality and facilitates detection of granularity, compared with the high tone and the low tone. The test pattern of the intermediate-tone image thus enables the dot recording positions to be adjusted with high accuracy.

In accordance with another preferable application of the print control apparatus of the present invention, the print head is capable of ejecting multiple inks of different hues, and the test pattern includes the first dot and the second dot, which are formed in different hues and partially overlap each other.

The partial overlap of the first dot and the second dot having different hues gives an area having a different hue from those of both the first dot and the second dot. Misalignment of the dot recording positions enhances a variation in hue in the test pattern. This arrangement thus facilitates detection of the positional misalignment.

In accordance with still another preferable application of the print control apparatus of the present invention, the print head is capable of ejecting multiple inks of different hues, and the driving module drives the print head in both a forward pass and a backward pass of the main scan. The first dot is a forward dot created in the forward pass of the main scan of the print head. The second dot is a backward dot created in the backward pass of the main scan of the print head. The test pattern includes the forward dot and the backward dot, both of which are created with multiple color inks.

Formation of the forward dot and the backward dot with multiple inks of different hues in the test pattern also facilitates detection of granularity due to the relative misalignment of the dot recording positions, thus enabling the ink ejection timing to be readily adjusted.

In the print control apparatus of the present invention, it is preferable that a spatial frequency of a variation in density in the main scanning direction in the test pattern ranges 0.4 to 2.0 cycles/mm.

As is well known, the human's visual sensitivity is high in this spatial frequency domain. Application of the test pattern having a variation in density in this spatial frequency domain enables the uneven density due to the positional misalignment of dots to be explicitly recognizable.

In accordance with another preferable application of the first print control apparatus, the test pattern data generation module includes: a memory that stores tone data of the test pattern; and a print data generation module that causes the tone data to be subjected to a halftoning process with a diffusion matrix, which diffuses a tone error arising in a pixel of interest currently processed to peripheral non-processed pixels with preset weights, and thereby generates print data used for printing the test pattern.

This arrangement does not require storage of the test pattern in the form of print data, thus desirably saving the storage capacity.

In this application, a diversity of matrixes that ensure substantially equivalent dispersibility of the first dot and the second dot may be used for the diffusion matrix. For example, the diffusion matrix may set either of zero and a negative value to an element corresponding to a pixel, which is expected to be in a state of dot formation identical with that in the pixel of interest.

The present invention is also directed to a second print control apparatus that supplies print data to a printing device, which creates dots and thereby carries out printing. The printing device includes: a print head having multiple nozzles, from which ink is ejected; a scanning module that carries out main scan and sub-scan of the print head; and a driving module that drives the print head during each scan and causes at least two different types of dots, a first dot and a second dot, to be created at different timings in respective pixels. The print control apparatus has a test pattern data generation module that generates test pattern data used for printing a predetermined test pattern. The test pattern is a patch pattern, in which dots are created at a preset recording rate in a predetermined area and substantially equal numbers of the first dot and the second dot are created with a substantially equivalent dispersibility over a practically whole area.

The test pattern used in the present invention is a patch pattern, in which dots are created at a preset recording rate in a predetermined area and substantially equal numbers of the first dot and the second dot are created with a substantially equivalent dispersibility over a practically whole area. The inventors of the present invention have found that creation of the substantially equal numbers of the first dot and the second dot with substantially equivalent dispersibility makes the rough touch due to the positional misalignment more conspicuous. The second print control apparatus utilizes this test pattern to adjust the dot recording positions with high accuracy.

The expression 'practically whole area' means that there may be a very little area in which the conditions of dispersibility and the number are not satisfied. The expression 'substantially equal number' means that the number of the first dots may not be strictly identical with the number of the second dots.

The present invention is further directed to a third print control apparatus that controls a printing device, the printing device comprising a print head with multiple nozzles, from which ink is ejected, and creating dots on a printing medium while carrying out main scan and sub-scan of the print head relative to the printing medium. The print control apparatus includes: a print mode setting module that selects and sets a print mode to be used for printing, among a plurality of print modes including a test pattern mode, which is used to print a predetermined test pattern; and a print control module that, in response to setting of the test pattern mode, controls the printing device to carry out the main scan and the sub-scan in a different condition from that in the other print modes.

In general, the arrangement of the first dot and the second dot depends upon the driving method of the print head and the feeding amounts in the course of printing. The inventors of the present invention have found that rough touch due to the positional misalignment of dots is conspicuous in some arrangements and relatively inconspicuous in other arrangement. In the case of printing letters and natural images, the arrangement that makes the rough touch inconspicuous is desirable to improve the printing quality. In the case of printing the test pattern, on the other hand, the arrangement that makes the rough touch conspicuous is desirable. The condition of the main scan and the sub-scan is selectively set for printing of the test pattern and for standard printing. The above application thus allows these two requirements to be compatible with each other.

From these viewpoints, it is preferable that in response to the setting of the test pattern mode, the main scan and the sub-scan are carried out in a condition that attains a higher visual recognizability with regard to positional misalignment of dots than that in the other print modes.

The condition of the main scan and the sub-scan represents a driving method of the print head and feeding amounts. In the specification hereof, such condition may be referred to as the 'dot recording method' or the 'recording method'.

The present invention is not restricted to the construction of the print control apparatus discussed above, but may be constructed as a printing apparatus including the printing device and the print control apparatus.

The present invention is also attained by a method of adjusting positional misalignment of dots.

The present invention is accordingly directed to a method of adjusting misalignment of recording positions between a first dot and a second dot, which are created at different timings by a printing device that includes a print head having multiple nozzles for ejecting ink and creates dots on a printing medium with the print head. The method includes the steps of: (a) driving the print head at a plurality of preset different timings and thereby printing a plurality of test patterns to allow detection of the misalignment of recording positions between the first dot and the second dot; (b) selecting an optimum test pattern among the plurality of printed test patterns; and (c) setting a drive timing of the print head corresponding to the selected test pattern.

The test pattern used here may be any of the diverse patterns discussed above with regard to the print control apparatus.

The present invention is also actualized as a computer program that causes a computer to attain the functions of the print control apparatus discussed above. Another construction of the present invention is a recording medium in which such a computer program is recorded in a computer readable manner.

There are a diversity of other applications of the present invention; for example, a test pattern, a method of printing the test pattern, computer programs that actualize any of the preceding applications, a recording medium in which any of the computer programs is recorded, and a data signal that includes the computer program and is embodied in a carrier wave.

The present invention is also directed to a fourth print control apparatus that supplies print data to a printing device, which creates dots and thereby carries out printing. The printing device includes: a print head having multiple nozzles, from which ink is ejected; a scanning module that carries out main scan and sub-scan of the print head; and a driving module that drives the print head during each scan and causes at least two different types of dots, a first dot and a second dot, to be created at different timings in respective pixels. The print control apparatus has a test pattern data generation module that generates test pattern data used for printing a predetermined test pattern. The test pattern is a patch pattern, in which substantially equal numbers of the first dot and the second dot are created at a preset recording rate in a predetermined area and a first area having a higher density of the first dot than a density of the second dot and a second area having a higher density of the second dot than a density of the first dot have a substantially equivalent size and are mixed in a main scanning direction and in a sub-scanning direction.

In the test pattern of the present invention, the first area having a higher density of the first dot than the density of the second dot and the second area having a higher density of the second dot than the density of the first dot are mixed in the main scanning direction and in the sub-scanning direction. While the first through the third print control apparatuses disperse the first dot and the second dot, the fourth print control apparatus localize the first dot and the second dot.

The inventors of the present invention have found that the clump formation of each of the first dots and the second dots, which are created at different timings, in the main scanning direction and in the sub-scanning direction enables the rough touch of the printed image due to the positional misalignment of dots to be easily recognized. The test pattern of the present invention makes the rough touch of the printed image due to the relative misalignment of dot recording positions significantly prominent. This arrangement thus facilitates detection of the relative misalignment of dot recording positions.

It is preferable that the first area and the second area do not have a significant difference in size. The substantially equivalent size does not mean that these areas are expected to have substantially fixed sizes over the whole range of the test pattern. The requirement is that the adjoining first area and second area locally have a substantially equivalent size.

The expression 'mixed in the main scanning direction and in the sub-scanning direction' includes the irregular arrangement of the first areas and the second areas in the test pattern, as well as the regular arrangement.

Any of the additional arrangements discussed above with regard to the first through the third print control apparatuses may be applied to the fourth print control apparatus. For example, the preset recording rate may be an intermediate tone. The first dot and the second dot may be created by nozzles having different positions in the main scanning direction. In one preferable application, the first dot is the forward dot and the second dot is the backward dot. The first dot and the second dot may be created with inks of different hues. Both the forward dot and the backward dot may be created with a plurality of different color inks. The spatial frequency of appearance of the first area and the second area in the main scanning direction ranges 0.4 to 2.0 [cycles/mm].

In accordance with one preferable application of the present invention, the fourth print control apparatus includes a printing condition input module that inputs a printing condition. Different test patterns are printed according to the input printing condition.

The blotting of ink, which affects the degree of rough touch in the printed image, depends upon the type of the printing medium, such as plain paper or special paper. The size of the dot also affects the degree of rough touch in the printed image. The arrangement of setting the test pattern according to the printing condition enhances the accuracy of detection of the rough touch.

The 'printing condition' is not restricted to the type of the printing medium or the dot size, but represents a general condition that affects the printing quality. The printing condition may be set by taking into account the upper limit quantity of ink (ink duty) on the printing medium in the printing environment (temperature and humidity).

In the print control apparatus of the present invention, print data used for printing the test pattern (test pattern data) may be stored in advance. In another preferable application, the print control apparatus may include: a memory that stores tone data of the test pattern; and a print data generation module that causes the tone data to be subjected to a halftoning process with a diffusion matrix, which diffuses a tone error arising in a pixel of interest currently processed to peripheral non-processed pixels with preset weights, and thereby generates print data used for printing the test pattern.

For generation of the test pattern data, the halftoning process is carried out with a diffusion matrix, which diffuses a tone error arising in a pixel of interest currently processed to peripheral non-processed pixels with preset weights. The error diffusion method or the least mean square error method.

The above arrangement does not require storage of plural test pattern data corresponding to diverse conditions. The required test pattern can be generated from stored tone data of the test pattern by changing the diffusion matrix.

As is well known, the diffusion matrix having a preset weight pattern is used for the error diffusion method. The probability of appearance of dots may be regulated by changing the diffusion matrix and a threshold value.

In a first application, the diffusion matrix sets a greatest value to elements corresponding to non-processed pixels adjoining to the pixel of interest in the main scanning direction and in the sub-scanning direction.

In this diffusion matrix, the dot on-off state in a certain pixel significantly affects the dot on-off state in adjoining pixels.

In a second application, the diffusion matrix sets either of zero and a negative value to an element corresponding to a pixel, which is expected to be in a state of dot formation identical with that in the pixel of interest.

No error division is distributed to the pixels having the value of '0' in this diffusion matrix. Namely the error diffusion does not affect the dot formation state in such pixels. There is a high possibility that the pixels having negative values are in a dot formation state identical with that in the pixel of interest. The 'dot formation state' here means the dot on-off state. The expression 'expected to be in an identical state of dot formation' does not mean positively making the identical state of dot formation, but means that application of this diffusion matrix attains the identical state of dot formation with high probability.

In a third application, the diffusion matrix sets either of a maximum value and a minimum value to a middle element among three consecutive elements aligned in the main scanning direction. This does not mean that only the value of the middle element is maximum or minimum. For example, when m1, m2, and m3 denote the value of three consecutive elements aligned in the main scanning direction, these values can hold any of the following relations: m1<m2=m3, m1<m2>m3, m1=m2>m3, m1>m2=m3, m1>m2<m3, m1=m2<m3. Setting the maximum value or the minimum value to m2 effectively regulates the probability of appearance of dots.

The present invention is further directed to a fifth print control apparatus that controls a printing device, the printing device comprising a print head with multiple nozzles, from which ink is ejected, and creating dots on a printing medium while carrying out main scan and sub-scan of the print head relative to the printing medium. The print control apparatus includes: a print mode setting module that selects and sets a print mode to be used for printing, among a plurality of print modes including a test pattern mode, which is used to print a predetermined test pattern; and a print control module that, in response to setting of the test pattern mode, causes video data of the test pattern to be subjected to a halftoning process in a condition proper to the test pattern, thus generating print data to be supplied to the printing device.

In general, the halftoning process applied for generation of print data affects the degree of rough touch in the resulting printed image. In the case of printing letters and natural images, the halftoning process that makes the rough touch inconspicuous is desirable to improve the printing quality. In the case of printing the test pattern, on the other hand, the halftoning process that makes the rough touch conspicuous is desirable. The halftoning process is selectively specified for printing of the test pattern and for standard printing. The above application thus allows these two requirements to be compatible with each other.

When the plurality of print modes include a text print mode for printing letters and a natural image print mode for printing a natural image, it is preferable that the print control module carries out different halftoning processes corresponding to the respective print modes.

The present invention is not restricted to the construction of the print control apparatus discussed above, but may be constructed as a printing apparatus including the printing device and the print control apparatus.

The present invention is also attained by a method of generating test pattern data.

The present invention is accordingly directed to a method of generating test pattern data, which is used to adjust misalignment of recording positions between a first dot and a second dot, which are created at different timings by a printing device that includes a print head having multiple nozzles for ejecting ink and creates dots on a printing medium with the print head. The method includes the steps of: (a) setting video data of a patched test pattern having a preset area; (b) specifying a dot recording method; and (c) carrying out a halftoning process with a diffusion matrix, which diffuses a tone error arising in a pixel of interest currently processed to peripheral non-processed pixels with preset weights. The diffusion matrix causes a first area having a higher density of the first dot than a density of the second dot and a second area having a higher density of the second dot than a density of the first dot to be mixed in a main scanning direction and in a sub-scanning direction.

The present invention is further attained by a method of adjusting positional misalignment of dots.

In the adjustment method, the print device is capable of creating N different types of dots (where N is an integer of not less than 2). The step (a) prints the test patterns with regard to M different types of dots (where M is an integer of not less than 2 and not greater than N) among the N different types of dots. The step (b) selects the optimum test patterns with regard to the M different types of dots. The step (c) determines the drive timing of the print head according to a predetermined function based on M drive timings of the print head corresponding to the selected M test patterns.

The latest printing apparatus utilizes a plurality of different types of dots, for example, dots of different hues, variable size dots, dots created with inks of different materials (for example, dye ink and pigment ink), for printing. The preferable procedure thus prints test patterns with regard to the plurality of different types of dots, selects optimum test patterns for the respective dots, and adjusts the drive timing of the print head based on the selected test patterns. This arrangement ensures adjustment with high accuracy. The adjustment may be performed for all the available dots or for only specific dots that significantly affect the printing quality. Another possible application calculates the rate of the respective dots from the video data to be printed and carries out the adjustment only for the frequently used dots.

The expression 'according to a predetermined function' means that input of a certain parameter is unequivocally mapped to a certain result. One applicable procedure averages the drive timings of the print head corresponding to the plurality of selected optimum test patterns (hereinafter referred to as the optimum timings). Another possible procedure sets the optimum timing of dot formation that most significantly affects the printing quality among the plurality of selected optimum timings. Still another possible procedure sets the most frequent optimum timing among the plurality of selected optimum timings. In the case where the plurality of selected optimum timings have a significant variation, the procedure may add predetermined weights to the respective optimum timings and set an intermediate timing.

The present invention is also actualized as a computer program that causes a computer to attain the functions of the print control apparatus discussed above. Another construction of the present invention is a recording medium in which such a computer program is recorded in a computer readable manner.

There are a diversity of applications of the present invention other than the print control apparatus, the printing apparatus, the method of generating test pattern data, and the adjustment method discussed above; for example, a test pattern, computer programs that actualize any of the preceding applications, a recording medium in which any of the computer programs is recorded, and a data signal that includes the computer program and is embodied in a carrier wave. The diverse arrangements discussed above may be added to any of these applications.

When the present invention is actualized as the computer program or the recording medium in which the computer program is recorded, the application may be the whole program for driving the print control apparatus or the printing apparatus or only an essential part of the program that attains the functions of the present invention. Typical examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

BRIEF DESCRIPTION OF THE DRAWINGS

FIG. 8 shows a dot recording process in a text print mode;

FIG. 10 shows a dot recording process in a natural image print mode;

FIG. 12 shows a dot recording process in a test pattern print mode;

FIG. 26 shows a dot recording process when the number of scans s is set equal to 4;

FIG. 29 shows results of the error diffusion process with regard to 14 consecutive pixels in the main scanning direction;

FIG. 30 shows a diffusion matrix in a first modified example;

FIG. 31 shows a diffusion matrix in a second modified example;

FIG. 32 shows a diffusion matrix in a third modified example;

FIG. 33 shows a diffusion matrix in a fourth modified example;

BEST MODES OF CARRYING OUT THE INVENTION

Some modes of carrying out the present invention are discussed below as preferred embodiments in the following sequence:

A. First Embodiment
A1. Construction of Apparatus
A2. Print Control
A3. Text Print Mode
A4. Natural Image Print Mode
A5. Test Pattern Print Mode
A6. Modified Example (1)
A7. Modified Example (2)
B. Second Embodiment
B1. Formation of Test Pattern
B2. Adjustment of Driving Timing
B3. Modified Example (1)
B4. Modified Example (2)
B5. Modified Example (3)
C. Modifications
C1. Modified Example (1)
C2. Modified Example (2)
C3. Modified Example (3)
C4. Modified Example (4)
C5. Modified Example (5)
C6. Modified Example (6)
C7. Modified Example (7)
C8. Modified Example (8)

A. First Embodiment

A1. Construction of Apparatus

Figure 1:
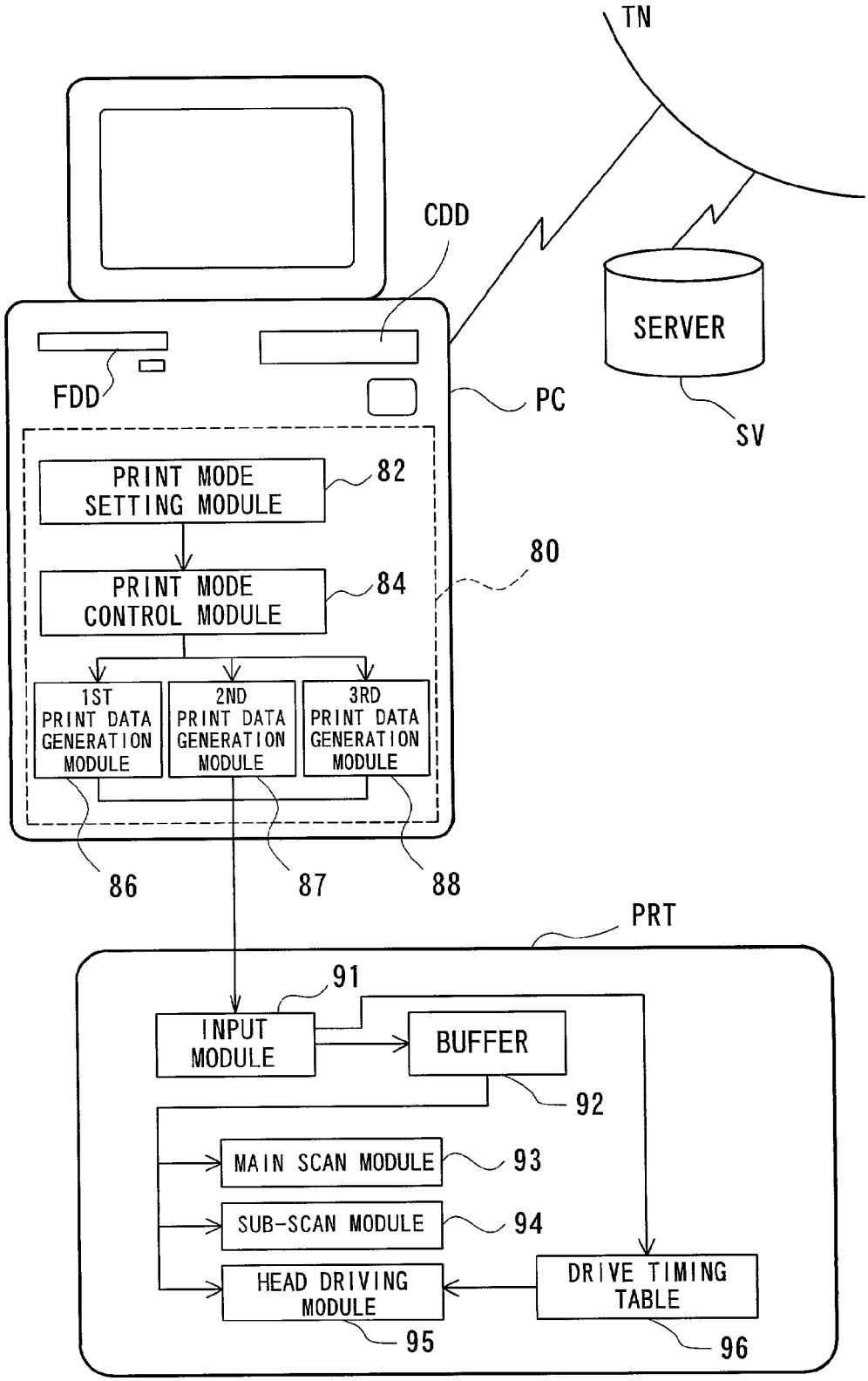
FIG. 1 is a block diagram illustrating the construction of a printing system in one embodiment of the present invention.

FIG. 1 is a block diagram illustrating the construction of a printing system in one embodiment of the present invention. A printer PRT connecting with a computer PC receives print data generated by a printer driver 80 in the computer PC and executes a printing operation. The print data includes raster data and feed data. The former data specifies the dot on-off state with regard to each pixel on each raster line. The latter data specifies feeding.

The computer PC can externally receive input of programs and data. The input may be implemented by downloading from a server SV on a network TN or by loading from a recording medium, such as a flexible disk or a CD-ROM, set in a flexible disk drive FDD or a CD-ROM drive CDD. The whole program required for printing may be input collectively, or respective functional modules may be input separately.

In the computer PC, application programs that create images and carry out diverse series of processing, for example, retouch, work under a predetermined operating system. The operating system includes the printer driver 80, that is, a program used for generating print data from video data. The printer driver 80 receives video data from the application program and generates print data.

The printer driver 80 includes functional blocks as illustrated.

A print mode setting module 82 sets a print mode. A text print mode for letters and characters, a natural image print mode for natural images, and a test pattern print mode for a test pattern are provided as possible options of the print mode.

A print mode control module 84 changes the current print mode to the newly set print mode and selectively uses print data generation modules. The print mode control module 84 uses a first print data generation module 86 in the text print mode, a second print data generation module 87 in the natural image print mode, and a third print data generation module 88 in the test pattern print mode. Video data corresponding to a test pattern is provided in advance in the third print data generation module 88. This embodiment uses a test pattern of a fixed tone value arranged in patches. The tone value of the test pattern may be set arbitrarily, and is specified as an intermediate tone in this embodiment.

Each of the print data generation modules 84 to 88 generates print data through a series of processing, that is, conversion of the resolution, color conversion, halftoning, and interlacing, in the corresponding print mode. The conversion of the resolution converts the resolution of video data into a resolution processible by the printer driver 80. The color conversion refers to a predetermined color conversion table and thereby converts the color space of video data into another color space used in the printer PRT, that is, a color space defined by cyan (C), light cyan (LC), magenta (M), light magenta (LM), yellow (Y), and black (K). The halftoning enables the tone values of the color-converted video data to be expressed as a distribution of dots. The halftoning process may follow the dither method or the error diffusion method. The interlacing sets feed data in the process of printing the halftoned video data and rearranges the video data to a predetermined format to be transferred to the printer PRT. Part of this series of processing may be carried out in the printer PRT.

The printer PRT has functional blocks as illustrated. An input module 91 receives print data transferred from the printer driver 80 and stores the input print data into a buffer 92. A main scan module 93 and a sub-scan module 94 carry out main scan of the print head and feed of printing paper according to the input print data. A head driving module 95 drives the print head at a driving timing set in a drive timing table 96 in the course of main scan. The print head is driven in both forward and backward passes of the main scan.

Figure 2:
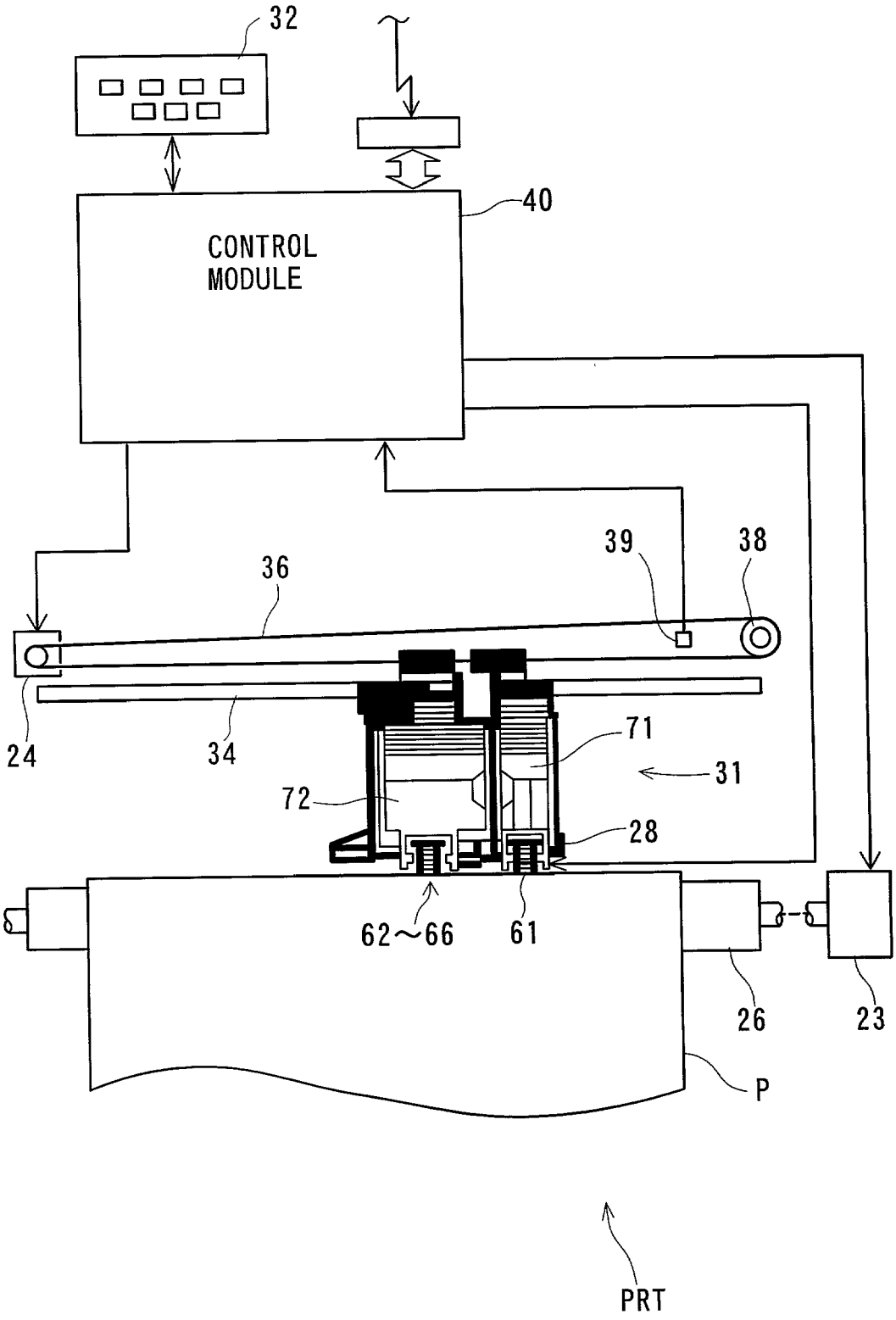
FIG. 2 schematically illustrates the structure of a printer PRT.

FIG. 2 schematically illustrates the structure of the printer PRT. As illustrated, the printer PRT has a mechanism of feeding a sheet of printing paper P by means of a sheet feed motor 23, a mechanism of moving a carriage 31 back and forth along an axis of a platen 26 by means of a carriage motor 24, a mechanism of driving a print head 28 mounted on the carriage 31 to control ink ejection and dot creation, and a control circuit 40 that is in charge of transmission of signals to and from the sheet feed motor 23, the carriage motor 24, the print head 28, and a control panel 32.

The mechanism of reciprocating the carriage 31 along the axis of the platen 26 includes a sliding shaft 34 that is arranged in parallel with the axis of the platen 26 to support the carriage 31 in a slidable manner, a pulley 38 that is combined with the carriage motor 24 to support an endless drive belt 36 spanned therebetween, and a position sensor 39 that detects the position of the origin of the carriage 31.

A black ink cartridge 71 for black ink and a color ink cartridge 72 in which five color inks, that is, cyan, light cyan, magenta, light magenta, and yellow, are accommodated are detachably attached to the carriage 31. Light cyan has a substantially identical hue but a lower density than cyan.

Light magenta has a substantially identical hue but a lower density than magenta. A total of six ink ejection heads 61 through 66 are formed on the print head 28 in the lower portion of the carriage 31. Ink conduits are formed in the bottom of the carriage 31 to lead supplies of inks from the ink reservoirs to the respective ink ejection heads 61 to 66.

Figure 3:
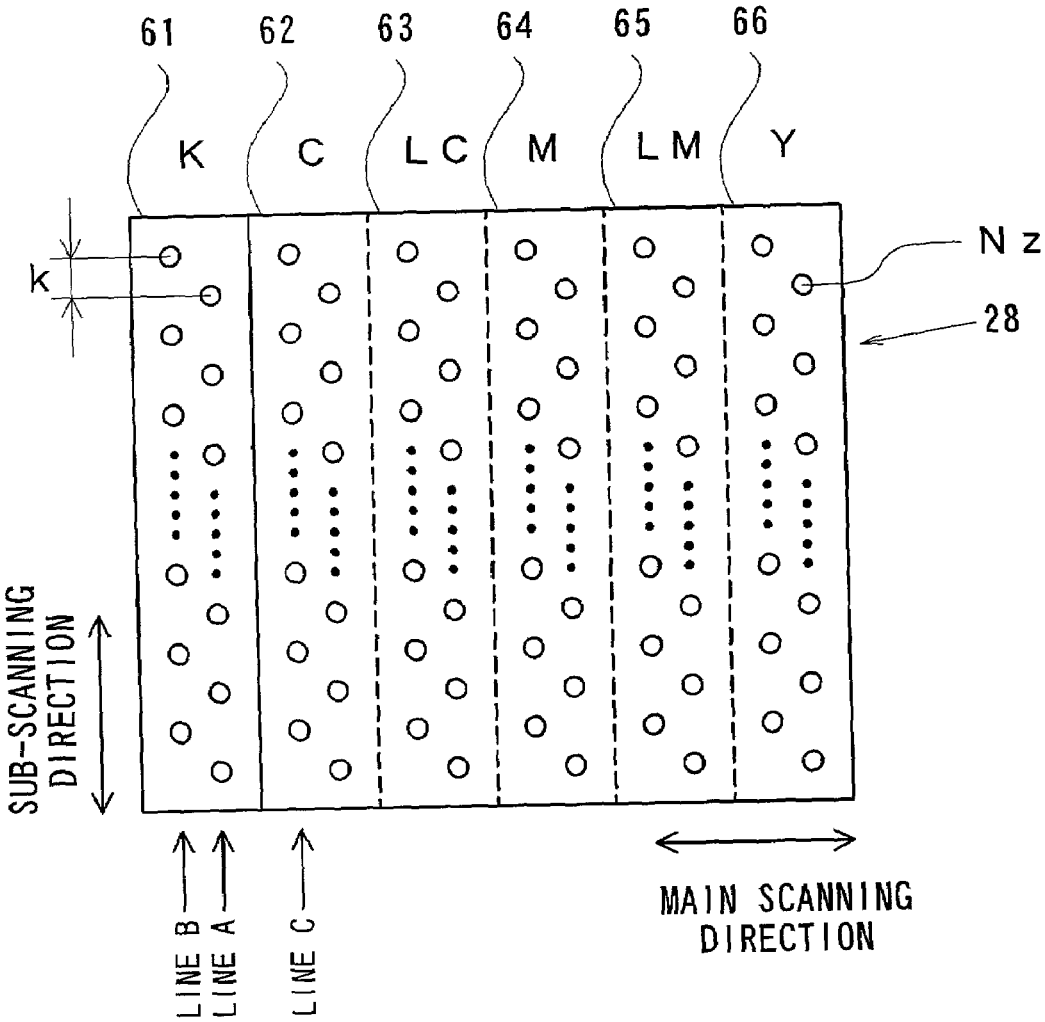
FIG. 3 shows an arrangement of nozzles Nz in ink ejection heads 61 to 66.

FIG. 3 shows an arrangement of nozzles Nz in the ink ejection heads 61 to 66. The corresponding nozzles in the respective ink ejection heads 61 to 66 are located at an identical position in a sub-scanning direction. Each of the ink ejection heads 61 to 66 has 48 nozzles Nz, from which each color ink is ejected. The nozzles Nz are arranged in zigzag at a fixed pitch k in the sub-scanning direction. The zigzag arrangement advantageously allows a small nozzle pitch in manufacture. The nozzles Nz may, however, be arranged in alignment.

Figure 4:
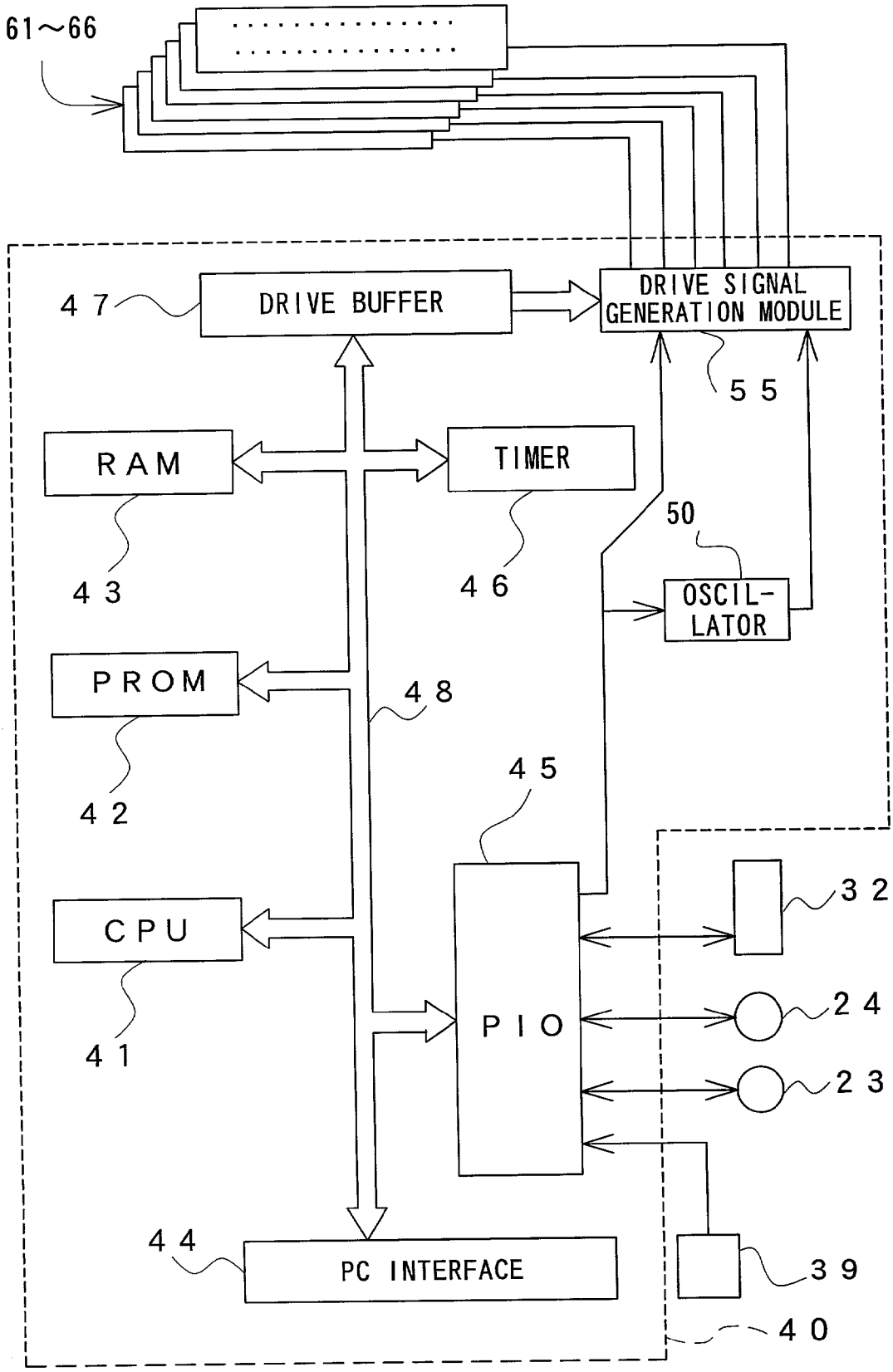
FIG. 4 shows the internal structure of a control circuit 40.

FIG. 4 shows the internal structure of the control circuit 40. As illustrated, the control circuit 40 includes a CPU 41, a PROM 42, a RAM 43, and a diversity of circuits discussed below, which are mutually connected via a bus 48. A PC interface 44 transmits data to and from the computer 90. A peripheral input-output module (PIO) 45 transmits signals to and from the sheet feed motor 23, the carriage motor 24, and the control panel 32. A clock 46 synchronizes the operations of the respective circuits. A diver buffer 47 outputs nozzle on-off signals, which specify the on-off state of the respective nozzles in the ink ejection heads 61 to 66, to a driving signal generation module 55.

The driving signal generation module 55 is connected with an oscillator 50. The oscillator 50 periodically outputs a clock signal as a reference for generation of a driving signal. The driving signal generation module 55 generates a driving waveform, which is to be output to each nozzle array in the ink ejection heads 61 to 66, based on the signal from the oscillator 50. As illustrated previously, the ink ejection heads 61 to 66 have multiple nozzle arrays that are located at different positions in a main scanning direction. The driving signal generation module 55 takes into account such positional difference and outputs the driving signal at specified output timings that ensure adequate dot positions. The output timings are specified separately for the forward pass and the backward pass of the main scan and are stored in the drive timing table 96 (see FIG. 1) included in the PROM 42.

Figure 5:
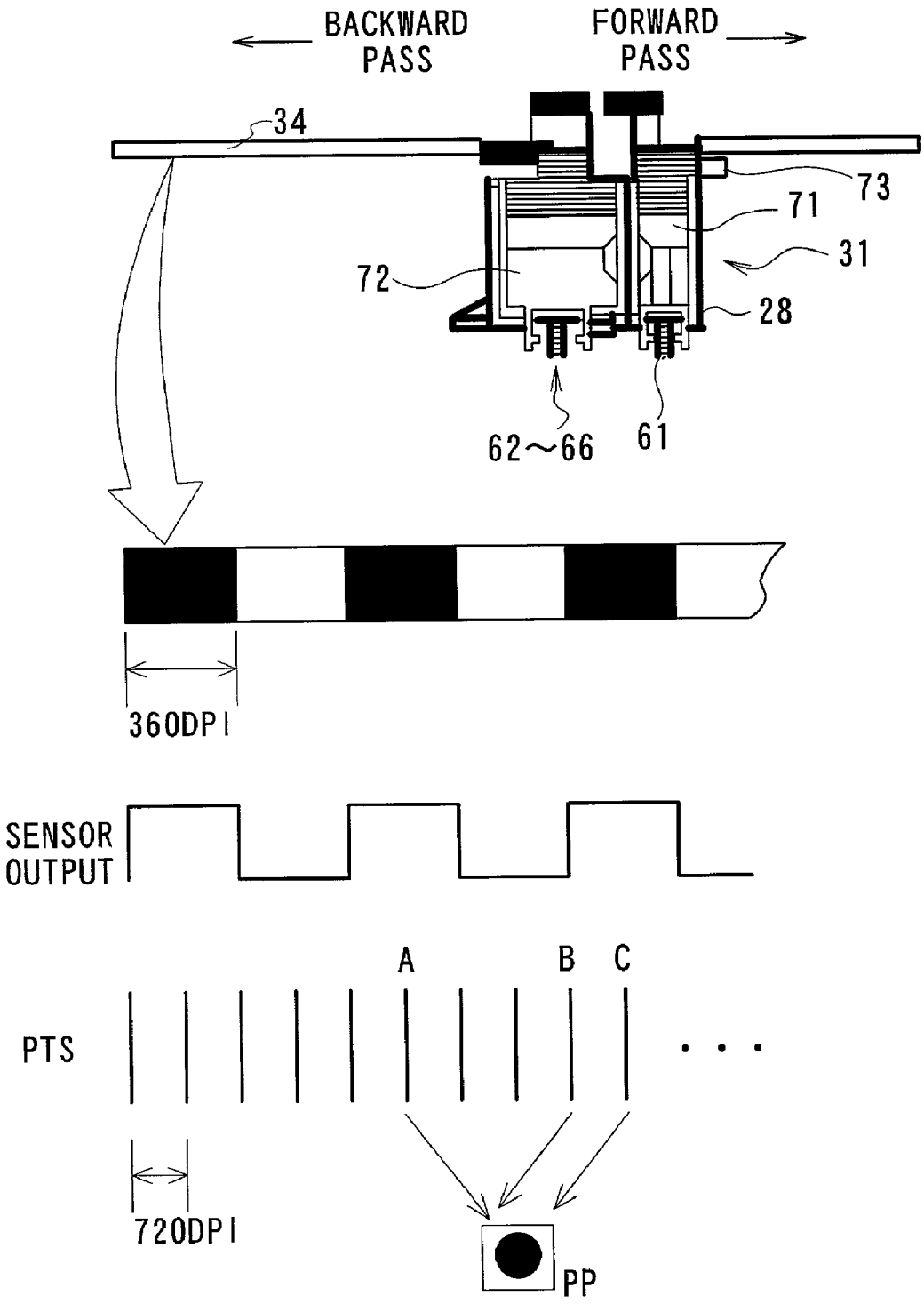
FIG. 5 shows generation of a reference signal PTS that defines the drive timing.

FIG. 5 shows generation of a reference signal PTS that defines the drive timing. The reference signal PTS is output corresponding to each pixel and defines the output of the driving waveform. As illustrated, the printer PRT has a linear scale that is disposed in parallel with the sliding shaft 34 and is painted in black at preset equal intervals. In this embodiment, the width of each black portion corresponds to twice the resolution, that is, the interval of 360 dpi. The carriage 31 has an optical sensor 73 that outputs an on-off signal corresponding to the painted portion or the non-painted portion, to which the sensor faces in the course of the movement of the carriage 31. The sensor output is illustrated in the drawing. The control circuit 40 utilizes this sensor output to detect the position of the carriage 31 in the main scanning direction. Equally dividing the sensor output enables the position of the carriage 31 to be detected at a higher resolution than the resolution of the painted portion. For example, halving the sensor output enables the position of the carriage 31 to be detected at the resolution of 720 dpi. The signal thus obtained is set as the reference signal PTS in the case of printing at the resolution of 720 dpi. The use of the optical sensor is not essential, but the reference signal PTS may be output at fixed time cycles from the beginning of the main scan. The use of the optical sensor, however, enhances the accuracy of the reference signal PTS.

Figure 6:
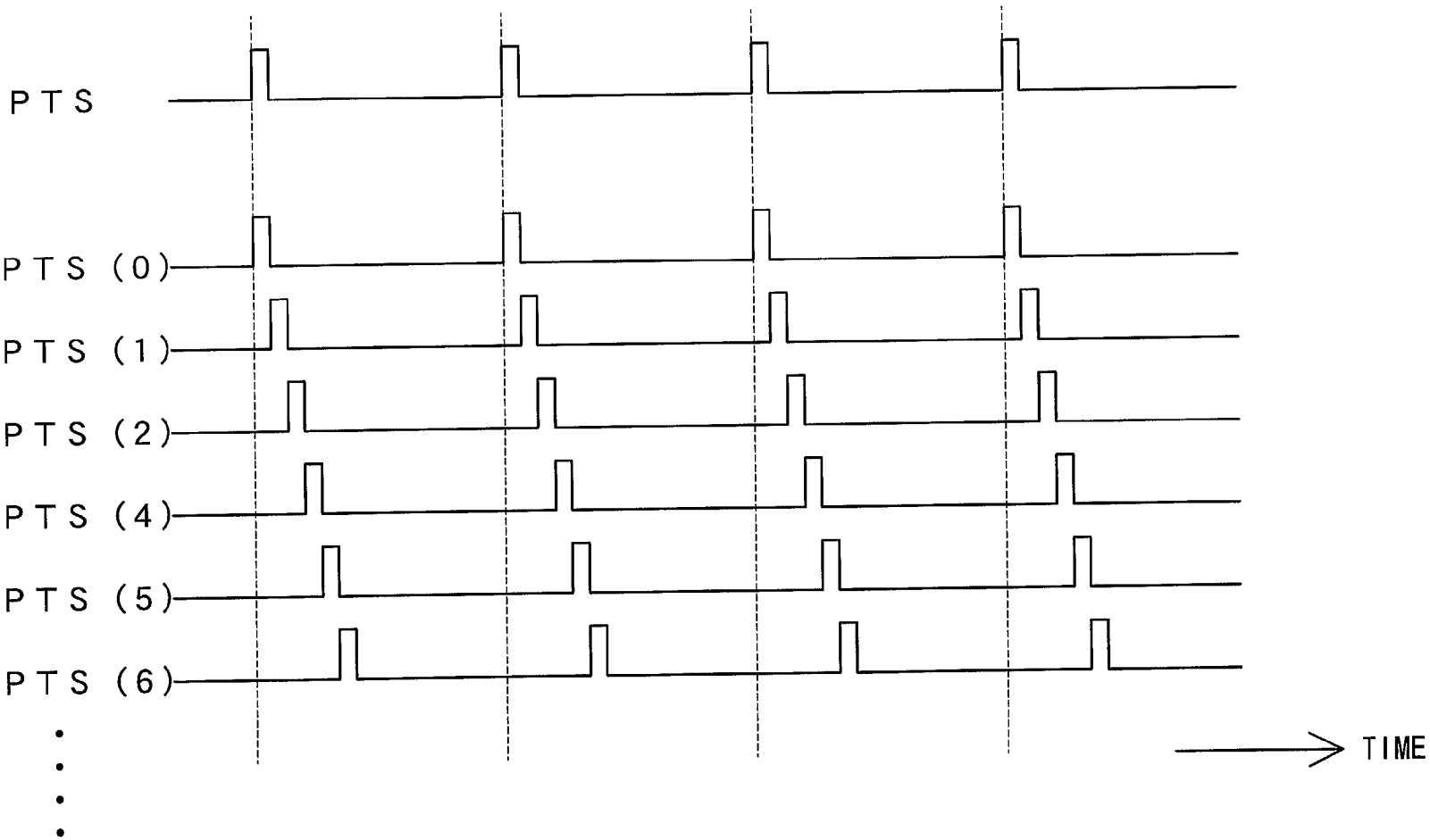
FIG. 6 shows the relationship between the reference signal PTS and drive timing signals.

FIG. 6 shows the relationship between the reference signal PTS and drive timing signals. Respective drive timing signals PTS(0), PTS(1), . . . are generated by applying delay signals to the reference signal PTS. The print head is driven in response to the delayed drive timing signals PTS(0), PTS(1), PTS(3), . . .

In the printer PRT having the hardware construction discussed above, the carriage motor 24 is driven to move the carriage 31 back and forth, while the sheet feed motor 23 is driven to feed the printing paper P. Simultaneously piezoelectric elements of the ink ejection heads 61 to 66 on the print head 28 are actuated to eject ink droplets of the respective colors and create ink dots, thereby printing a multi-color multi-tone image on the printing paper P.

A2. Print Control

Figure 7:
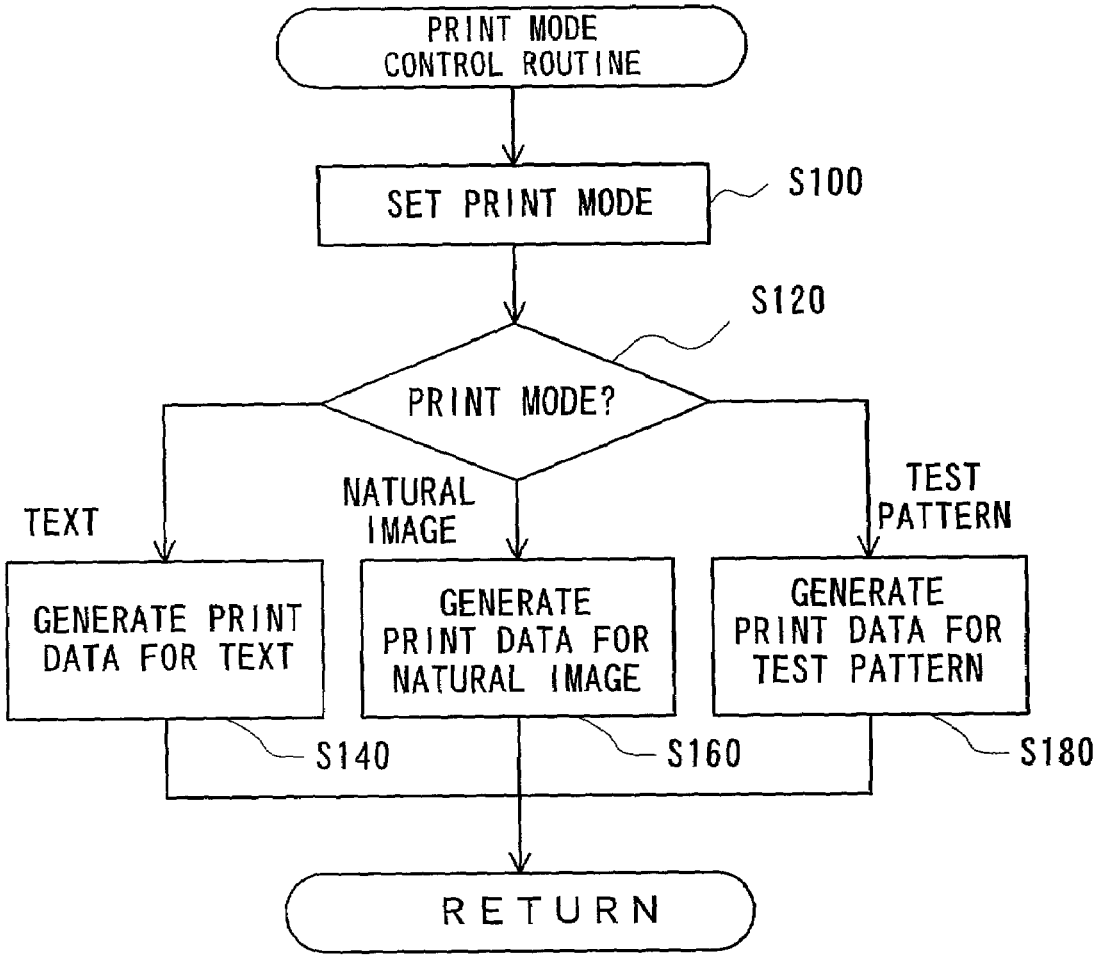
FIG. 7 is a flowchart showing a print mode control routine.

FIG. 7 is a flowchart showing a print mode control routine. This routine is executed by a CPU in the computer PC. When the program enters this routine, the CPU first sets the print mode (step S100). The CPU generates print data for a text (step S140) in the case of setting the text print mode (step S120), generates print data for a natural image (step S160) in the case of setting the natural image print mode (step S120), and generates print data for a test pattern (step S180) in the case of setting the test pattern print mode (step S120).

As mentioned previously, the print data includes raster data that specifies the dot on-off state with regard to each pixel on each raster line and feed data that specifies feeding. The printer PRT receives these data and executes printing.

A3. Text Print Mode

FIG. 8 shows a dot recording process in the text print mode. The upper portion of the drawing shows main parameters in this recording process, for example, feeds in $1^{st}$ through $13^{th}$ passes. Here each pass represents one forward movement or backward movement in the main scan. The symbol '%' denotes an operator giving a surplus. The horizontal position is a parameter showing the position of pixels to be recorded. The horizontal position '1' represents pixels of odd ordinal numbers on each raster line. The horizontal position '2' represents pixels of even ordinal numbers on each raster line. In this recording process, one cycle includes respective 6 sub-scans with feeds of 21 raster lines and 26 raster lines, that is, a total of 12 (=k·s) sub-scans.

The lower portion of FIG. 8 shows nozzle numbers allocated to nozzles used for dot recording on each raster line. Dots are recorded by the forward scan in passes of odd ordinal numbers, whereas dots are recorded by the backward scan in passes of even ordinal numbers. In the illustration, nozzles used in the backward passes are surrounded by thick lines. As illustrated, each raster line is formed with two different nozzles in the forward pass and in the backward pass.

In the text print mode, k=6 and s=2. Each unit is accordingly an area of 12 pixels, that is, 2 pixels in the main scanning direction and 6 pixels in the sub-scanning direction. Dots in the whole image are created in a fixed order by 12 passes. The right portion of FIG. 8 shows the dot recording positions in the 12 passes corresponding to the raster line numbers 2 to 7 and the horizontal positions. The numeral in each rectangle represents a pass number. Pixels of odd ordinal numbers are recorded in the passes 1, 11, 9, 7, 5, and 3, whereas pixels of even ordinal numbers are recorded in the passes 8, 6, 4, 2, 12, and 10. This means that forward dots are recorded in the pixels of the odd ordinal numbers and backward dots are recorded in the pixels of the even ordinal numbers. The dots created in consecutive passes have different horizontal positions. Even in the case of a large dot diameter, this arrangement effectively prevents blotting and other possible drawbacks due to overlap of adjoining dots.

Figure 9:
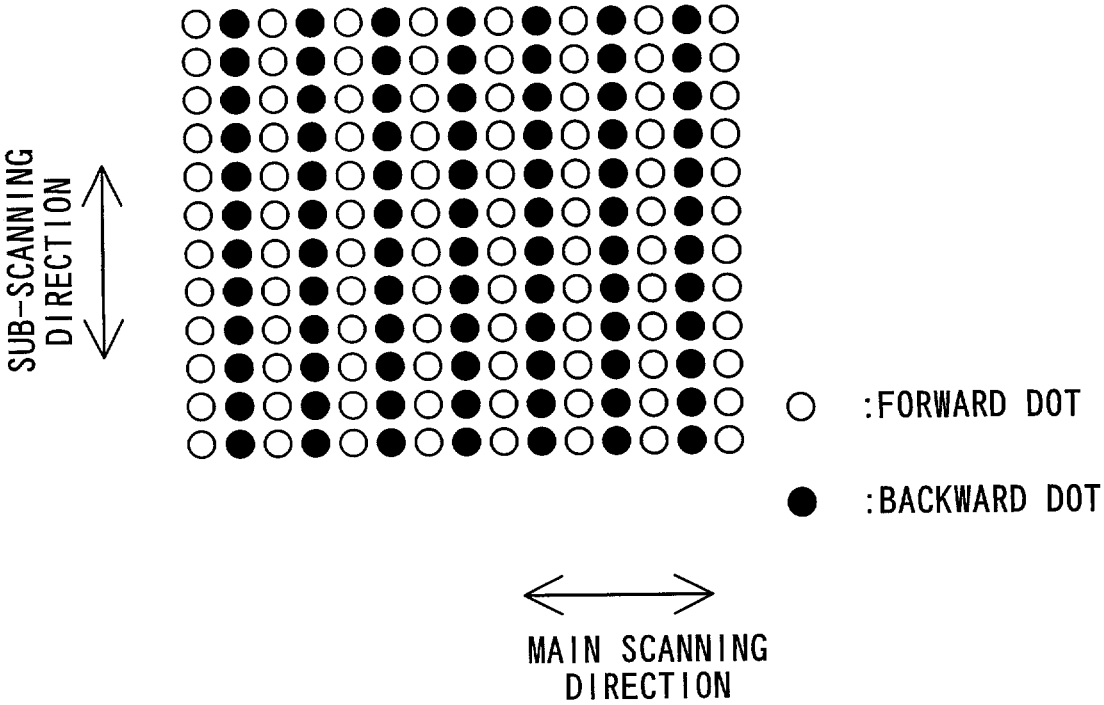
FIG. 9 shows dots in the text print mode.

FIG. 9 shows dots in the text print mode. The open circles represent forward dots or dots created in the forward pass, and the closed circles represent backward dots or dots created in the backward pass. As illustrated, in the text print mode, the forward dot and the backward dot are created alternately in the main scanning direction, and either the forward dot or the backward dot is uniformly created in the sub-scanning direction.

A4. Natural Image Print Mode

FIG. 10 shows a dot recording process in the natural image print mode. One cycle includes respective 2 sub-scans with feeds of 20, 27, 22, 28, 21, and 26 raster lines, that is, a total of 12 sub-scans.

The lower portion of FIG. 10 shows nozzle numbers allocated to nozzles used for dot recording on each raster line. Dots are recorded by the forward scan in passes of odd ordinal numbers, whereas dots are recorded by the backward scan in passes of even ordinal numbers. Either the forward dot or the backward dot is uniformly created on each raster line. Three adjoining raster lines with the forward dots and another three adjoining raster lines with the backward dots appear alternately.

The right portion of FIG. 10 shows the dot recording positions in the 12 passes. Pixels of odd ordinal numbers are recorded in the passes 1, 5, 8, 10, 12, and 3, whereas pixels of even ordinal numbers are recorded in the passes 7, 11, 2, 4, 6, and 9. This means that the raster lines 2, 3, and 7 are recorded in the forward scan and the raster lines 4, 5, and 6 are recorded in the backward scan.

Figure 11:
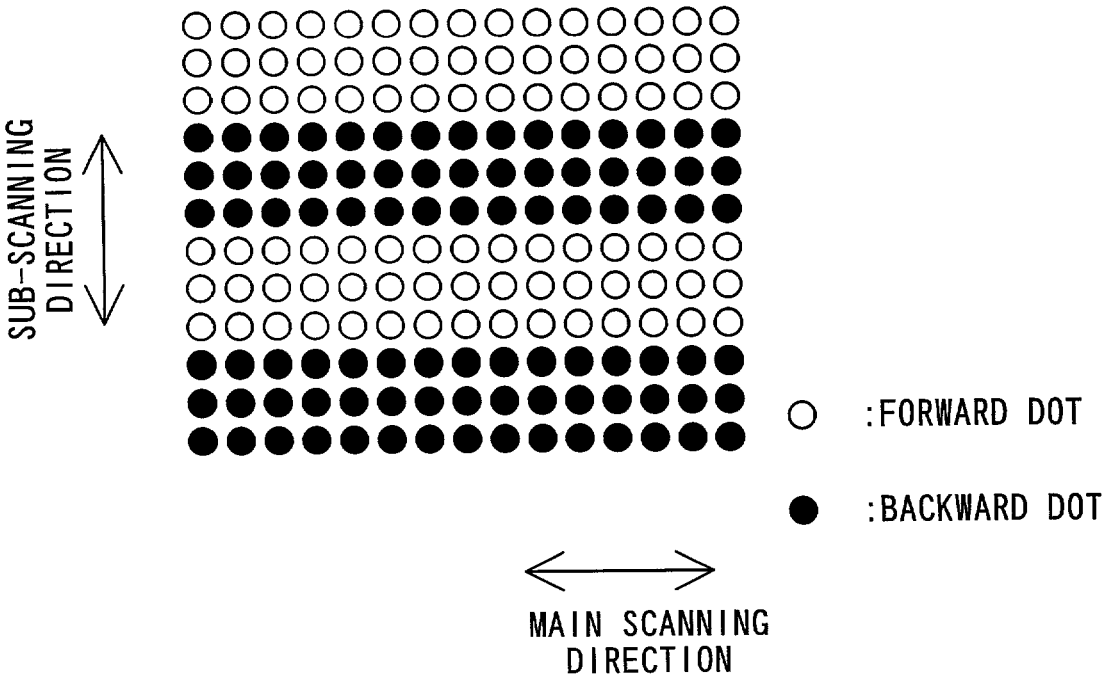
FIG. 11 shows dots in the natural image print mode.

FIG. 11 shows dots in the natural image print mode. The open circles represent forward dots and the closed circles represent backward dots. As illustrated, in the natural image print mode, three raster lines formed with only the forward dots and another three raster lines formed with only the backward dots appear alternately.

A5. Test Pattern Print Mode

FIG. 12 shows a dot recording process in the test pattern print mode. Each cycle includes respective 6 sub-scans with feeds of 21 and 26 raster lines, that is, a total of 12 sub-scans.

The lower portion of FIG. 12 shows nozzle numbers allocated to nozzles used for dot recording on each raster line. The forward dots and the backward dots are mixed on each raster line.

The right portion of FIG. 12 shows the dot recording positions in the 12 passes. Pixels of odd ordinal numbers are recorded in the passes 1, 6, 9, 2, 5, and 10, whereas pixels of even ordinal numbers are recorded in the passes 8, 11, 4, 7, 12, and 3. The forward dots and the backward dots are accordingly recorded checkerwise.

Figure 13:
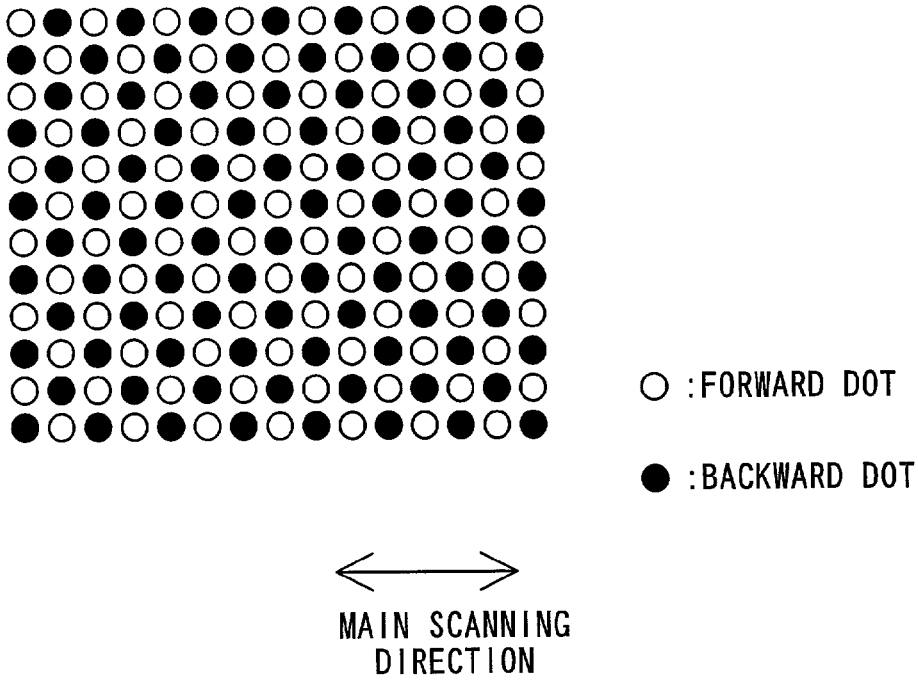
FIG. 13 shows dots in the test pattern print mode.

FIG. 13 shows dots in the test pattern print mode. The checkerwise arrangement of the forward dot and the backward dot causes the effects of the positional misalignment of dots to conspicuously appear as rough touch of the image.

Figure 14:
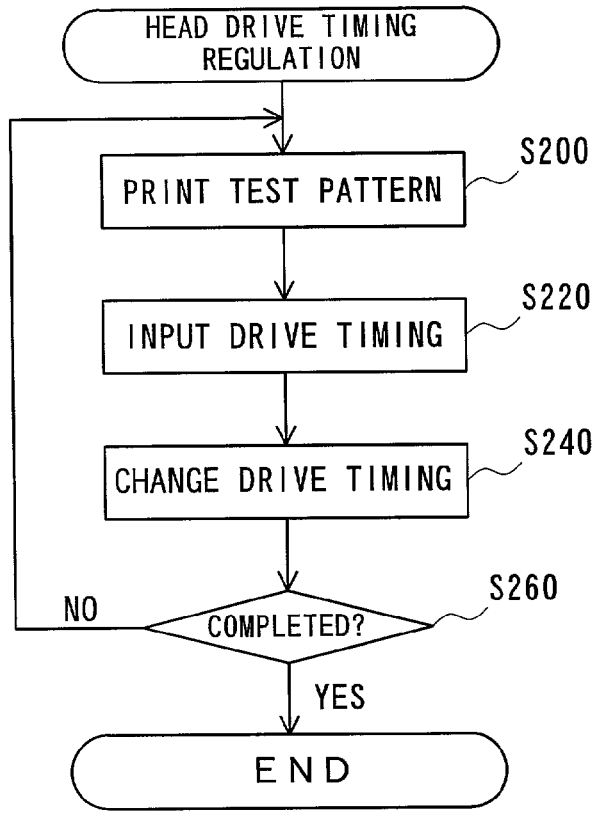
FIG. 14 is a flowchart showing a routine of regulating the drive timing of a print head.

FIG. 14 is a flowchart showing a routine of regulating the drive timing of the print head. The process first prints the test pattern shown in FIG. 13 at a plurality of different drive timings (step S200).

Figure 15:
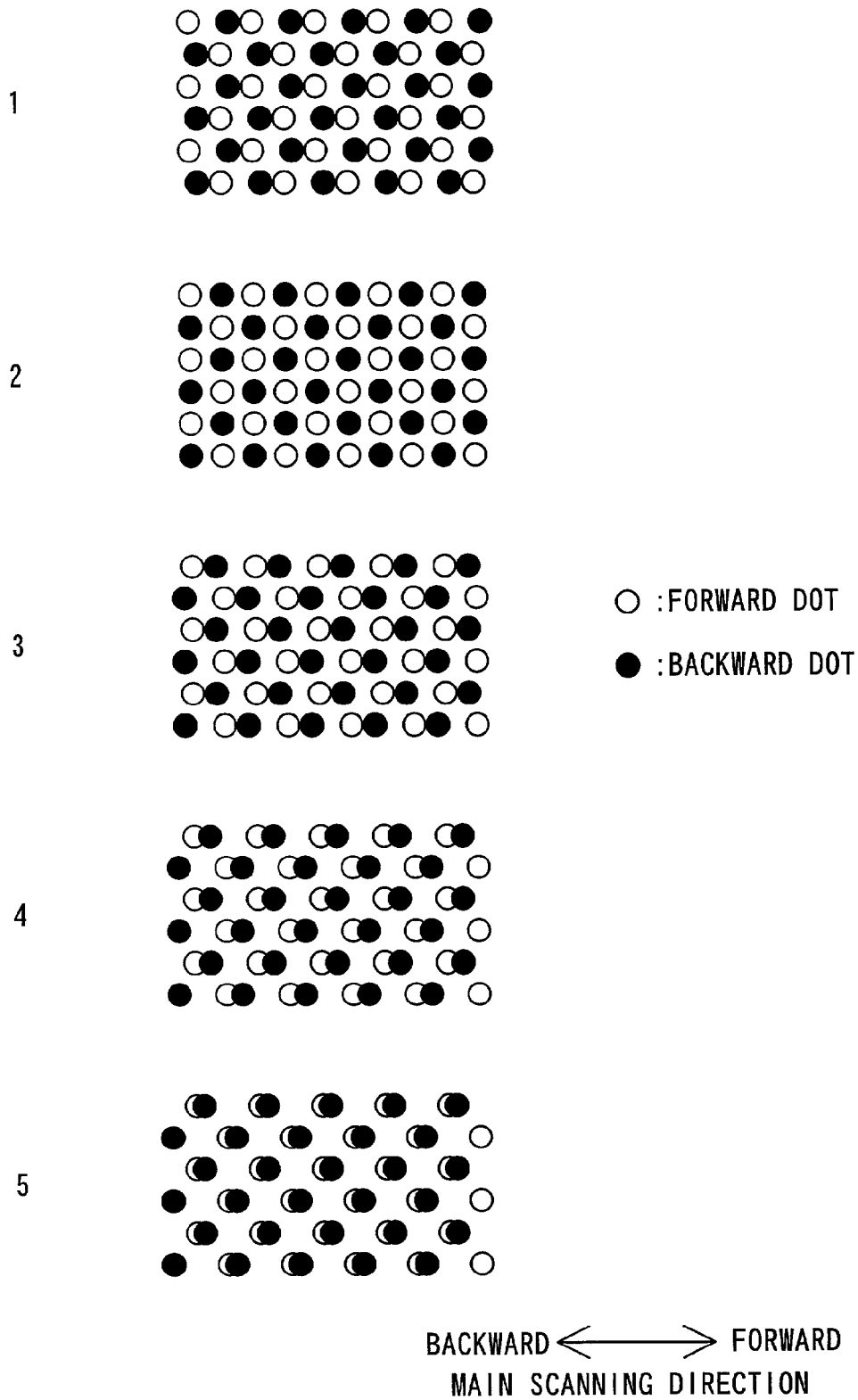
FIG. 15 shows printed test patterns.

FIG. 15 shows printed test patterns. An identical color ink is used for recording both the forward dot and the backward dot in this embodiment. The test pattern is recorded by varying the drive timing of the backward dot relative to the drive timing of the forward dot by five different stages. Numerals 1 to 5 respectively correspond to the five drive timings. The drive timing is changed by the method discussed previously with FIG. 6. The forward dots are printed in response to the drive timing signal PTS(0) used as the reference. The backward dots in the test patterns 1 to 5 are printed at five different timings in response to the drive timing signals PTS(1) to PTS(5).

It is here assumed that the drive timing signal PTS(3) is stored as the drive timing of the backward dot in the drive timing table 96 of the printer PRT. In this embodiment, the drive timing is shifted to two earlier stages and two behind stages relative to the stored drive timing, and the total of five test patterns are printed. The plural drive timings used for recording the test pattern may be set arbitrarily.

The user regulates the drive timing with these test patterns according to the following procedure. In the test pattern 1, since the drive timing is earlier than the optimum state, the backward dots are deviated rightward from the forward dots. In the test pattern 2, the backward dots are recorded at adequate positions. This means that the drive timing stored in the drive timing table 96 is behind the suitable timing by one stage. In the test patterns 3, 4, and 5, the drive timings are behind the optimum state, so that the backward dots are deviated leftward from the forward dots. The relative positional misalignment of the forward dots and the backward dots as shown in the test patterns 1, 3, 4, and 5 causes undesirable blanks between adjoining dots. This gives the rough touch and makes the uneven density visually recognizable. The user accurately recognize the deviation of the drive timing based on the degree of rough touch.

The user selects the test pattern with the least rough touch among the printed test patterns and inputs the number '2' allocated to the selected test pattern (step S220 in FIG. 13). The control circuit 40 changes the registration in the drive timing table 96 to the drive timing corresponding to the input number (step S240). In the case where the result of the adjustment with the printed test patterns is insufficient, for example, when there is a significantly large deviation of the dot drive timings, the above series of processing is carried out iteratively to complete the adjustment (step S260).

In the printing system of the first embodiment discussed above, the test pattern including the forward dots and the backward dots arranged checkerwise is used to adjust the drive timing with high accuracy. The suitable recording method is selected according to the print mode. This arrangement ensures adequate printing in each print mode. The recording method that causes the positional misalignment of dots to significantly affect the picture quality is adopted in the test pattern print mode. This enhances the accuracy of adjustment of the drive timing. In the natural image print mode, on the other hand, the dot recording method that minimizes the effects of the positional misalignment of dots on the picture quality is used to improve the picture quality.

A6. Modified Example (1)

The procedure of the first embodiment generates print data from video data corresponding to a test pattern and prints the test pattern. The test pattern may alternatively be kept in the form of print data.

Figure 16:
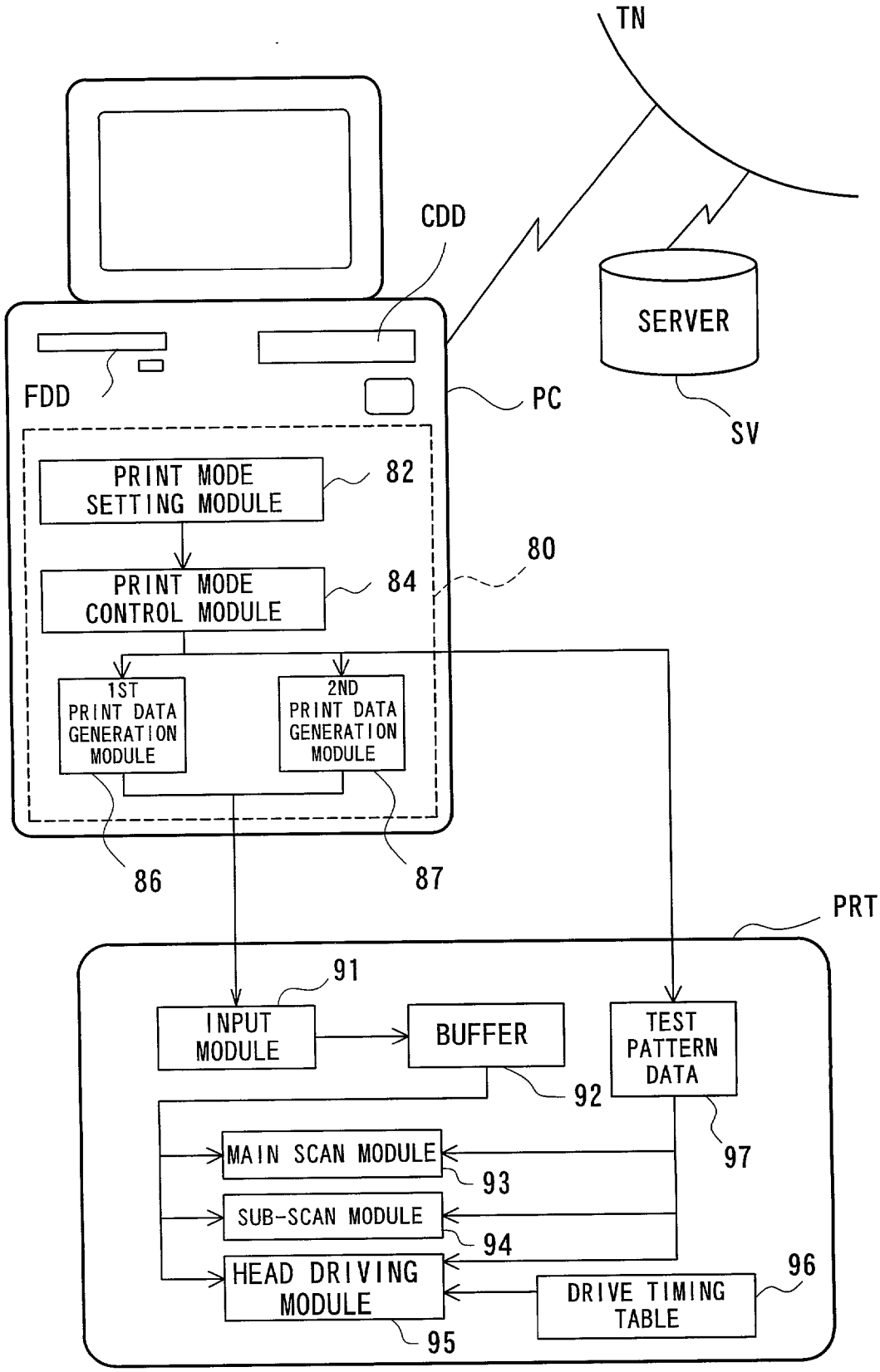
FIG. 16 is a block diagram illustrating the structure of another printing system in one modification of the first embodiment.

FIG. 16 is a block diagram illustrating the structure of another printing system in one modification of the first embodiment. In this modified example, the printer driver 80 does not have a print data generation module for printing the test pattern (the third print data generation module 88 shown in FIG. 1), while the printer PRT stores test pattern data 97 therein. The test pattern data 97 is print data used for printing test pattern and includes raster data and feed data. This print data is equivalent to the data generated by the third print data generation module 88 in the first embodiment. In this modified example, in the setting of the test pattern print mode, the test pattern data is directly supplied to the main scan module 93, the sub-scan module 94, and the head driving module 95. The test pattern data may alternatively be stored in the printer driver 80.

A7. Modified Example (2)

A diversity of patterns in which the forward dot and the backward dot adjoin to each other are applicable for the test pattern. The term 'adjoin' is not restricted to the case in which the forward dot and the backward dot are recorded in adjacent pixels, but includes the case in which there is a blank pixel between the forward dot and the backward dot.

Figure 17:
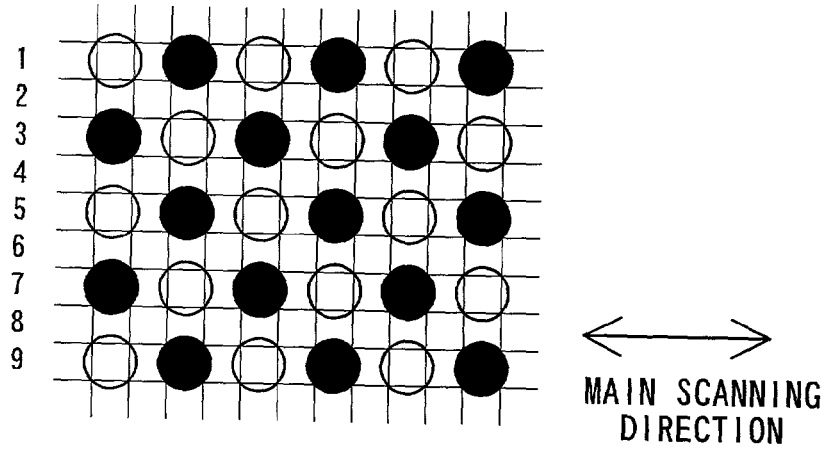
FIG. 17 shows a test pattern in one modified example.
Figure 18:
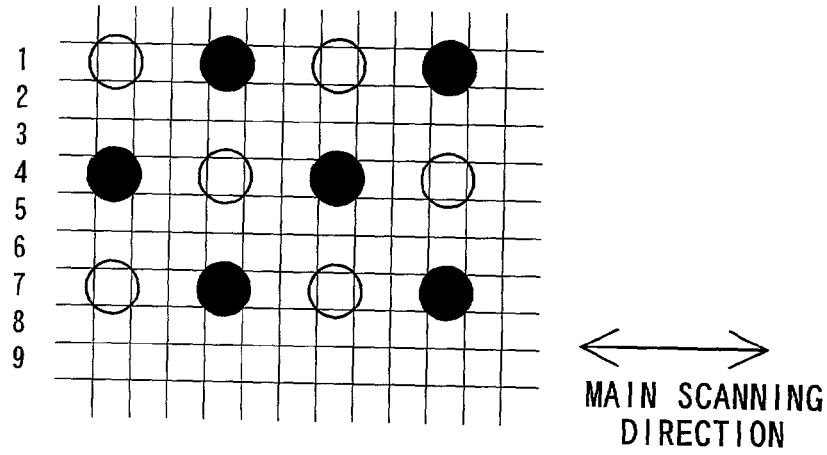
FIG. 18 shows a test pattern in another modified example.
Figure 19:
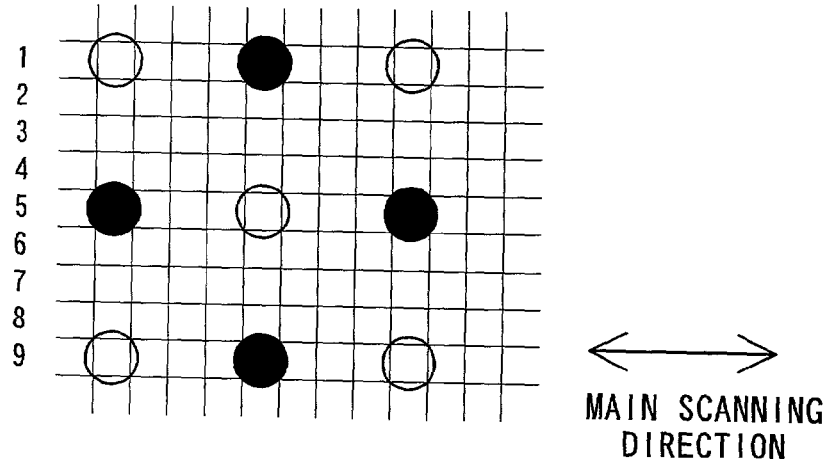
FIG. 19 shows a test pattern in still another modified example.

FIGS. 17 through 19 show test patterns in modified examples. Ike the test pattern of the embodiment, the forward dots and the backward dots are arranged checkerwise in these examples. The dot recording densities of these examples are all lower than the dot recording density of the embodiment, and decrease in the order of FIG. 17, FIG. 18, and FIG. 19. Like the test pattern of the embodiment, the rough touch due to the positional misalignment is readily recognizable in such test patterns including blank pixels between adjoining dots.

Figure 20:
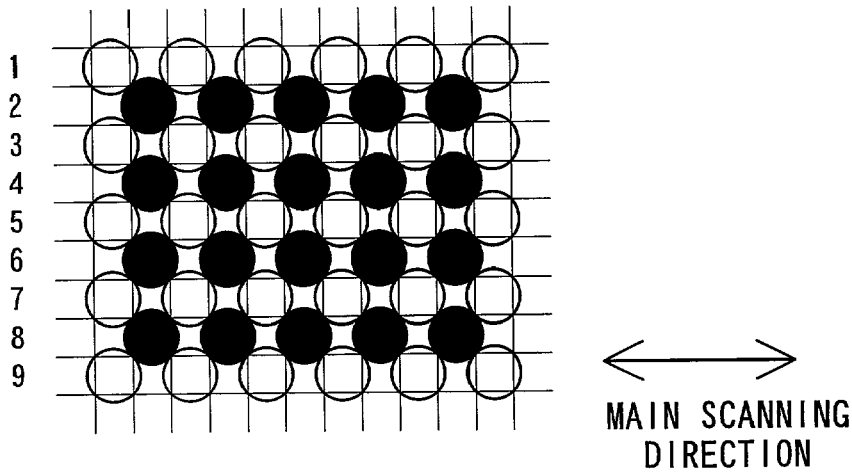
FIG. 20 shows a test pattern in another modified example.
Figure 21:
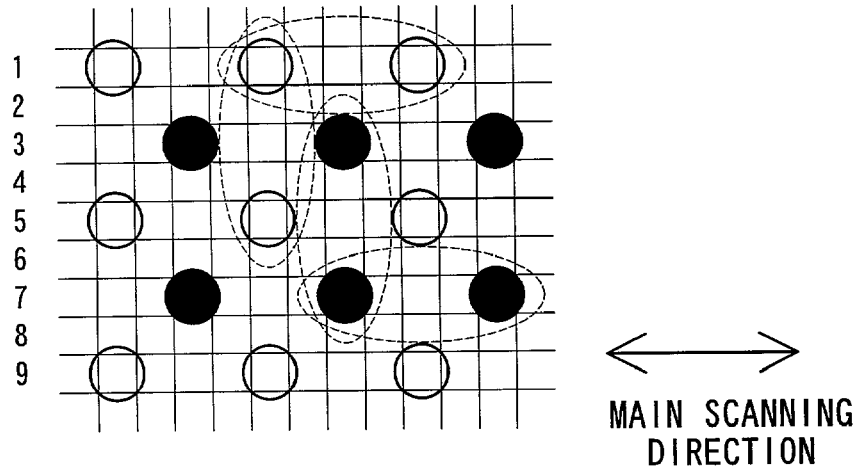
FIG. 21 shows a test pattern in another modified example.
Figure 22:
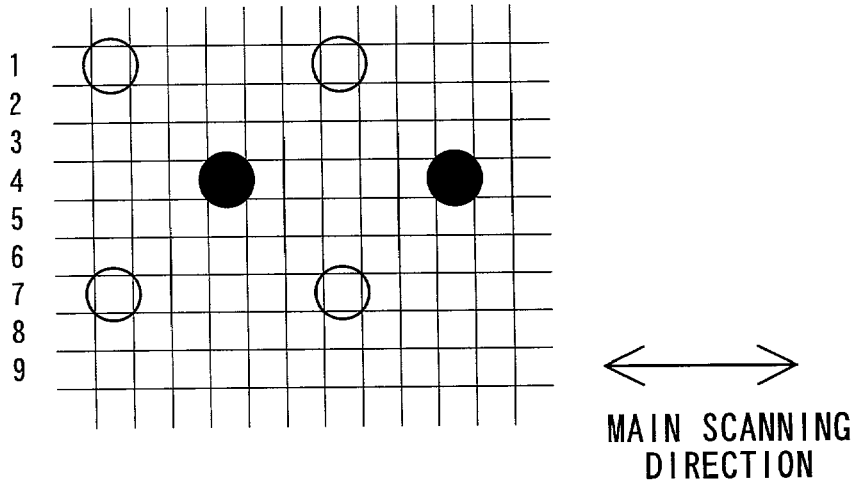
FIG. 22 shows a test pattern in another modified example.

The forward dot and the backward dot are not required to adjoin to each other in the main scanning direction or in the sub-scanning direction. The forward dot and the backward dot may be adjacent to each other in an oblique direction. FIGS. 20 through 22 show test patterns in other modified examples. The dot recording density decreases in the order of FIG. 20, FIG. 21, and FIG. 22. As shown by the broken line areas in FIG. 21, both the forward dots and the backward dots align in the main scanning direction and in the sub-scanning direction, whereas the forward dot and the backward dot adjoin to each other in the oblique direction.

Figure 23:
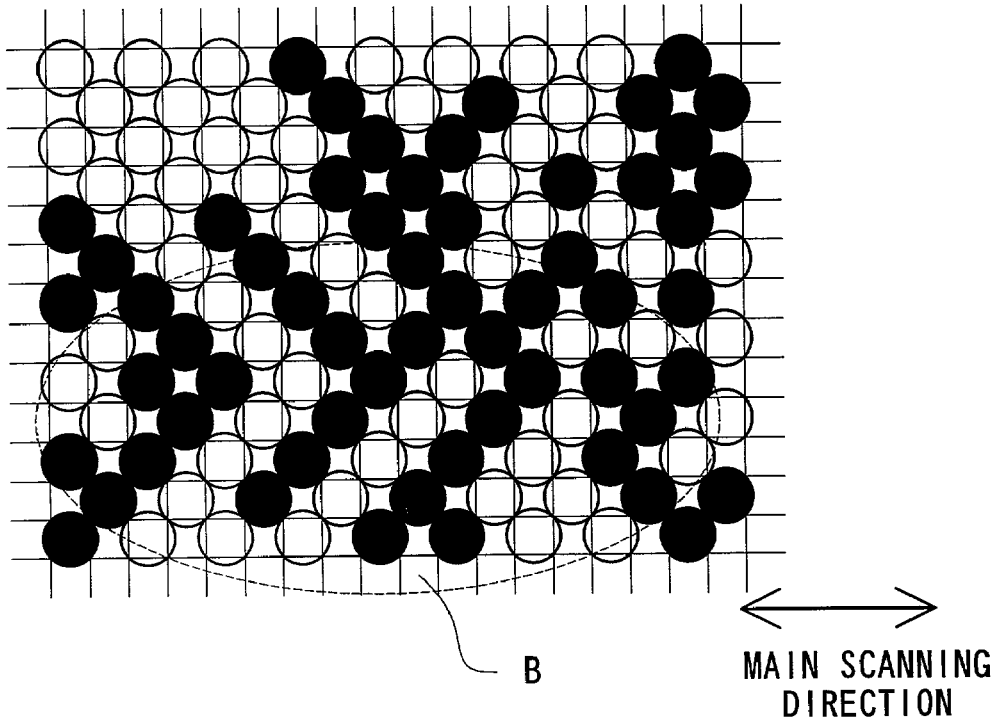
FIG. 23 shows a test pattern in which the forward dot and the backward dot are arranged in an irregular manner.

The test pattern is not restricted to the regular arrangement. FIG. 23 shows a test pattern in which the forward dot and the backward dot are arranged in an irregular manner. Irrespective of the irregular arrangement of the forward dot and the backward dot, these two dots are mixed with substantially equal dispersibility in an area B encircled by the broken line. In this area, the rough touch due to the positional misalignment is clearly recognizable.

Figure 24:
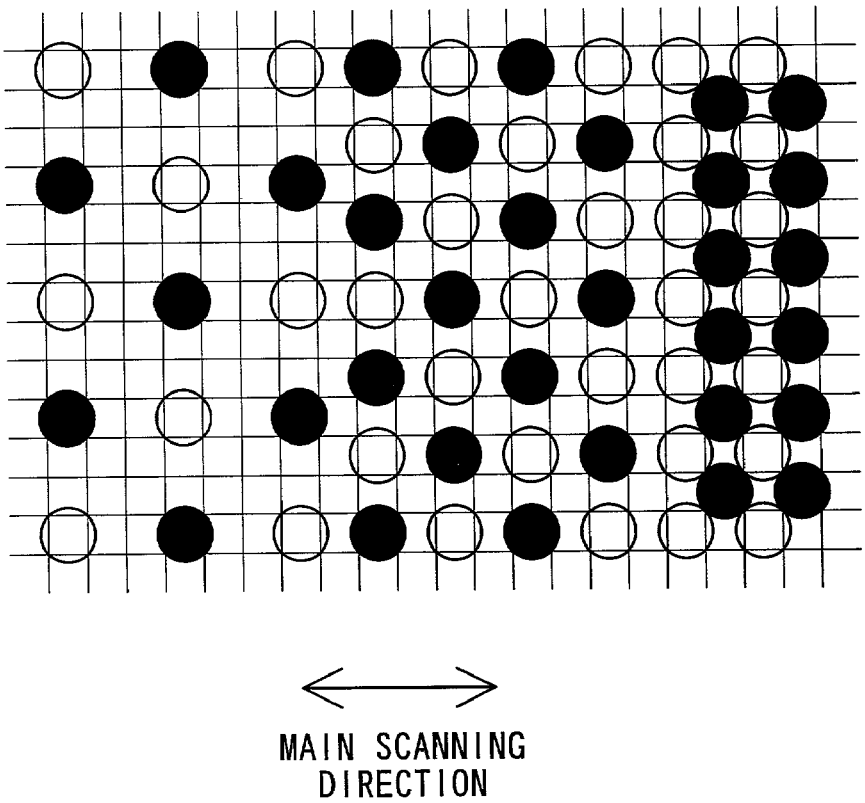
FIG. 24 shows a test pattern in another modified example.

The test pattern is not required to have a constant recording rate over the whole area. FIG. 24 shows a test pattern in another modified example. In this test pattern, the recording rate gradually varies in the main scanning direction. In this test pattern, equivalent numbers of the forward dots and the backward dots are mixed with substantially equal dispersibility. The test pattern thus clearly shows the rough touch due to the positional misalignment.

B. Second Embodiment

The first embodiment utilizes the test pattern in which the forward dots and the backward dots are mixed with substantially equal dispersibility. The second embodiment, on the other hand, w utilizes a test pattern in which the forward dots and the backward dots are localized.

The hardware construction and the software configuration of the second embodiment are identical with those of the first embodiment. The difference between the first embodiment and the second embodiment is the type of the pre-stored test pattern. The test pattern of the second embodiment is formed according to the procedure discussed below.

B1. Formation of Test Pattern

Figure 25:
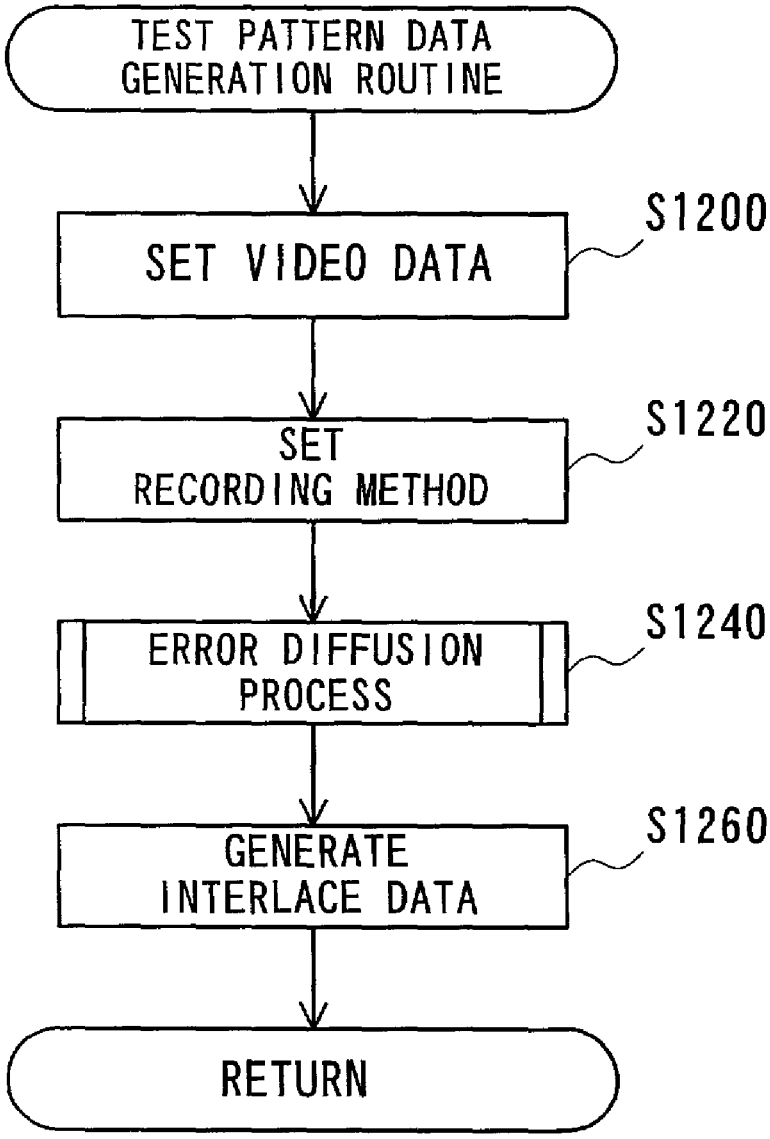
FIG. 25 is a flowchart showing a process of generating test pattern data.

FIG. 25 is a flowchart showing a process of generating test pattern data. The procedure first sets video data of a test pattern (step S1200). Here the video data has a fixed tone value arranged in patch.

The procedure subsequently sets the dot recording method (step S1220). The dot recording method may be specified arbitrarily. This embodiment adopts the recording method discussed previously with FIG. 12, that is, the recording method that gives the pixels with the forward dots and the pixels with the backward dots arranged checkerwise.

In the example of FIG. 12, the number of scans s is equal to 2. The checkerwise arrangement is also actualized when the number of scans s is equal to 4. FIG. 26 shows a dot recording process when the number of scans s is set equal to 4. In this example, one cycle includes respective 12 sub-scans with feeds of 9 raster lines and 14 raster lines, that is, a total of 24 (=k·s) sub-scans.

The lower portion of FIG. 26 shows nozzle numbers allocated to nozzles used for dot recording on each raster line. In the illustration, nozzles used in the backward passes are surrounded by thick lines. As illustrated, each raster line is formed with four different nozzles in the forward pass and in the backward pass.

In this embodiment, k=6 and s=4. Each unit is accordingly an area of 24 pixels, that is, 4 pixels in the main scanning direction and 6 pixels in the sub-scanning direction. Dots in the whole image are created in a fixed order by 24 passes. The right portion of the illustration shows the mapping of the pass numbers to the horizontal position of pixels. Pixels in the first horizontal position are recorded in the passes 1, 18, 9, 2, 17, and 10. Pixels in the second horizontal position are recorded in the passes 20, 11, 4, 19, 12, and 3. Pixels in the third horizontal position are recorded in the passes 13, 6, 21, 14, 5, and 22. Pixels in the fourth horizontal position are recorded in the passes 8, 23, 16, 7, 24, and 15.

The recording method set at step S1220 is not restricted to this example, but may be specified arbitrarily.

Figure 27:
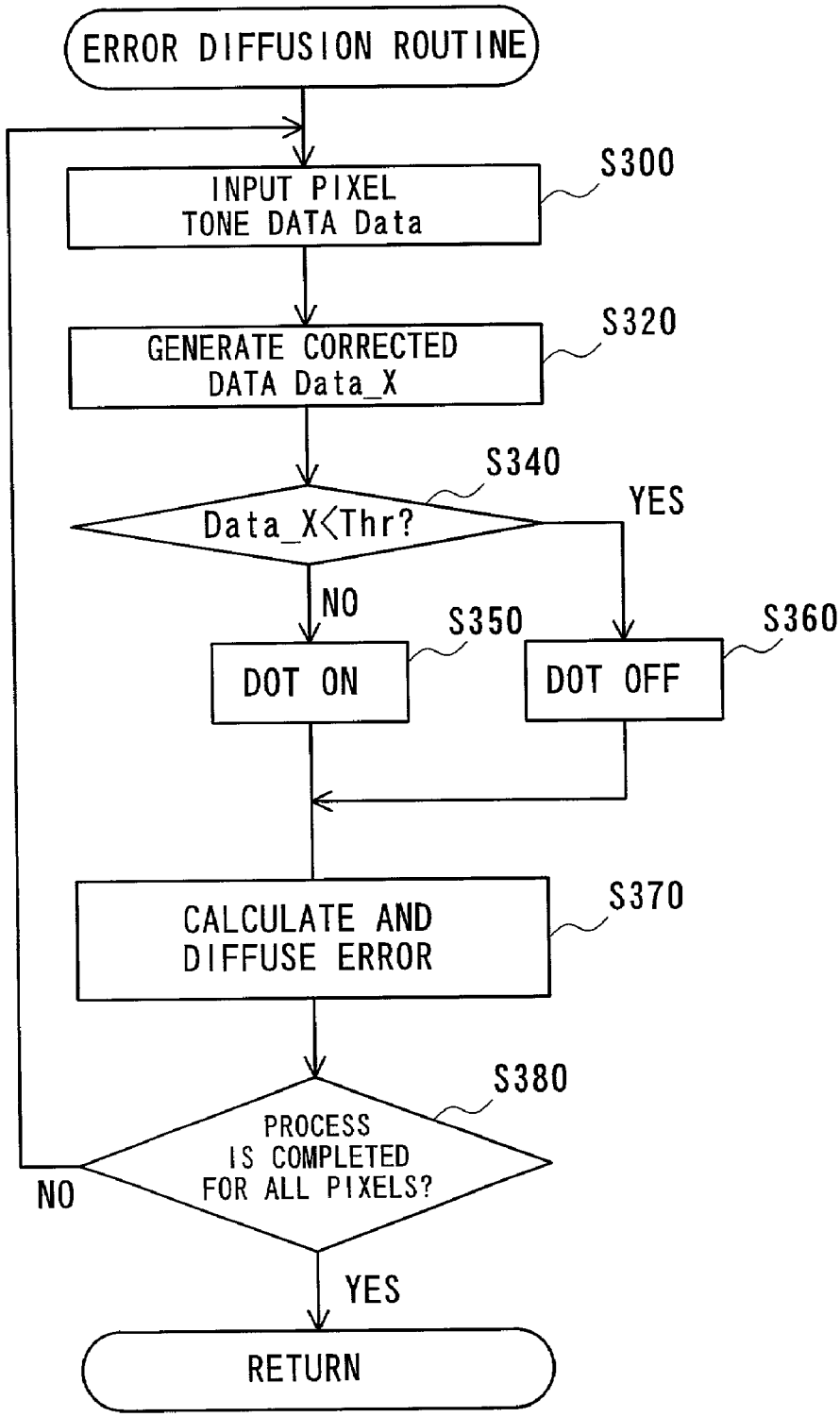
FIG. 27 is a flowchart showing an error diffusion routine.

After setting the dot recording method, the procedure carries out error diffusion (step S1240 in FIG. 25). FIG. 27 is a flowchart showing an error diffusion routine. The following description regards the case of binarization. The CPU first inputs video data of the test pattern as tone data Data of each pixel (step S300). As mentioned previously, the test pattern used in this embodiment has a fixed tone value arranged in patch.

The CPU then generates corrected data Data_X, on which diffusion error divisions distributed from peripheral processed pixels are reflected (step S320). When the corrected data Data_X is not less than a threshold value Thr (step S340), the pixel is set in the dot ON state (step S350). When the corrected data Data_X is less than the threshold value Thr, the pixel is set in the dot OFF state (step S360).

After specifying the dot on-off state, the CPU calculates an error and diffuses the calculated error, based on the specification (step S370). The error is calculated as a difference between a density evaluation value expressed in each pixel and the corrected data Data_X. The process of diffusion distributes the error to peripheral non-processed pixels according to the dither matrix with preset weights. The diffusion matrix will be discussed later.

After carrying out the above series of processing with regard to all the pixels (step S380), the procedure returns to the routine of FIG. 25 and generates interlace data (step S1260 in FIG. 25).

Figure 28:
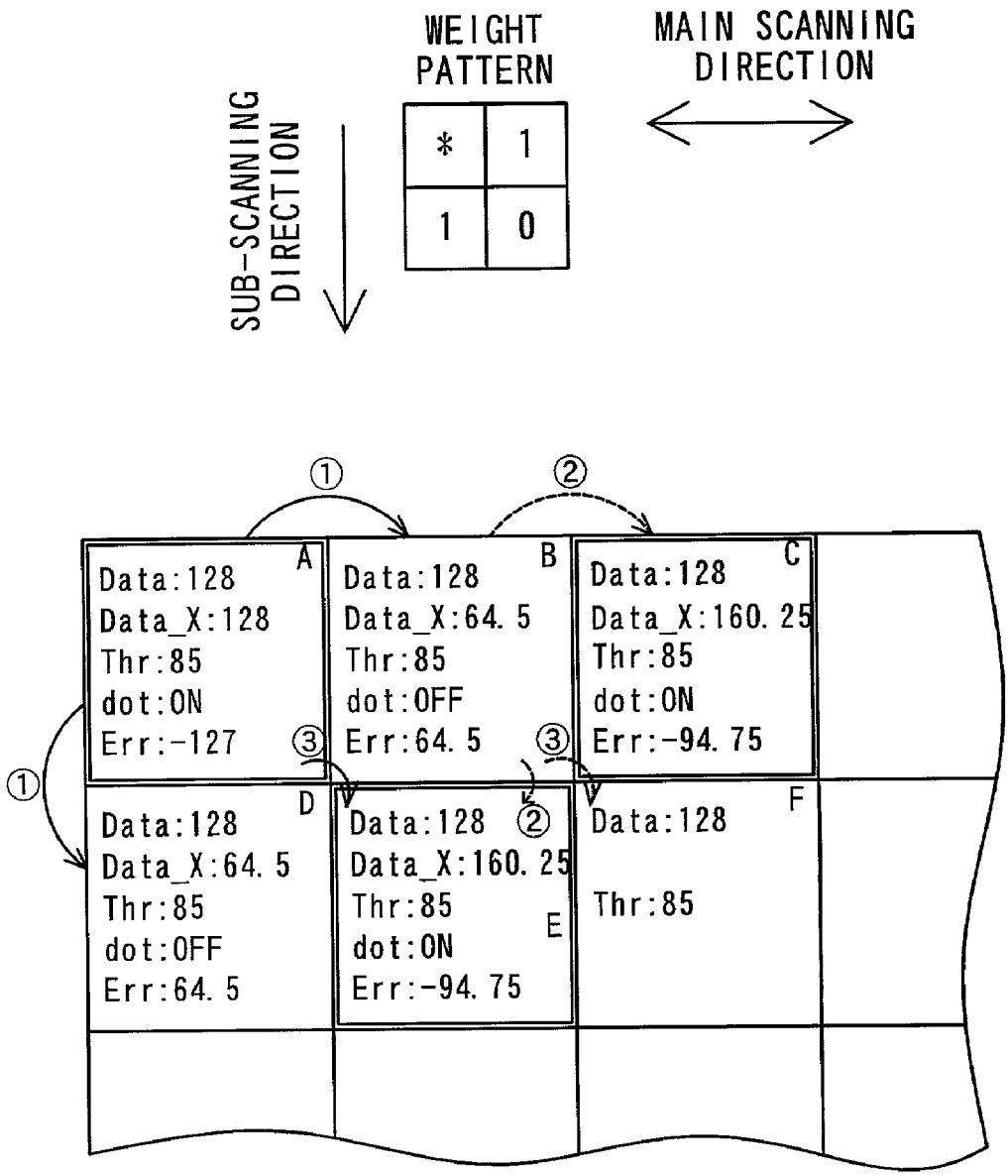
FIG. 28 shows a process of error diffusion.

FIG. 28 shows a process of error diffusion. In this example, the tone data Data of respective pixels have a fixed value of 128 out of 256 tones of 0 to 255.

The upper portion of FIG. 28 shows the weight pattern of a diffusion matrix used for the processing. The symbol '*' in the rectangle represents a pixel of interest or a target pixel of processing, and numerals represent weights. In this diffusion matrix, the tone error arising in the pixel of interest is distributed to non-processed pixels on the right side of and immediately below the pixel of interest at a ratio of 1 to 1. Half the tone error is accordingly distributed to each of these non-processed pixels.

The results of the processing are shown in the lower portion of FIG. 28. The threshold value Thr used for the processing is all equal to 85. Each rectangle represents a pixel, and the double-lined rectangle represents a pixel of the dot ON state.

The pixel of interest is an upper left pixel A. Since the tone data Data=128(Data_X=128) and the threshold value Thr=85, the dot ON state is set in this pixel A. The pixel A has a density evaluation value of 255. There is accordingly a tone error Err=−127. This tone error Err is distributed according to the dither matrix. An error division Derr '−63.5' is then diffused to pixels B and D.

The processing then shifts to the pixel B. In the pixel B, the diffused error division Derr '−63.5' is reflected on the tone data Data '128', and the corrected data Data_X=64.5 is obtained. The dot OFF state is accordingly set to the pixel B. The pixel B has a density evaluation value of 0 and a tone error Err=64.5. This tone error Err is distributed to pixels C and E according to the diffusion matrix. This series of processing is repeated to specify the on-off state in all the pixels.

FIG. 29 shows results of the error diffusion process with regard to 14 consecutive pixels in the main scanning direction. Numerals in the upper most row represent numbers allocated to the respective pixels. The numeral 1 corresponds to the pixel A, and the numeral 2 corresponds to the pixel B. The pixel having a parameter Result of 255 are set in the dot ON state, while the pixels having the parameter Result of 0 are set in the dot OFF state.

Among the pixels 1 to 7, the odd-number pixels are set in the dot ON state, and the even-number pixels are set in the dot OFF state. As discussed previously, this embodiment adopts the dot recording method that arranges the forward dots and the backward dots checkerwise (see FIG. 12). In this area, the density of the forward dot is higher than the density of the backward dot.

Among the pixels 8 to 14, on the other hand, the odd-number pixels are set in the dot OFF state, and the even-number pixels are set in the dot ON state. In this area, the density of the backward dot is higher than the density of the forward dot.

In this manner, the areas in which either the forward dot or the backward dot is localized are mixed in the main scanning direction and in the sub-scanning direction. This arrangement makes the positional misalignment of dots explicitly recognizable.

The diffusion matrix is not restricted to the example of FIG. 28, but may be set arbitrarily. FIG. 30 shows a diffusion matrix in a first modified example. In this diffusion matrix, the greatest weight is applied to pixels adjoining to the pixel of interest in the main scanning direction and in the sub-scanning direction. This diffusion matrix causes the dot on-off state in the pixel of interest to significantly affect the dot on-off state in adjoining pixels. In the example of FIG. 30, there are some pixels having the weight of '1' other than the adjoining pixels, although the weight '1' is still the maximum in this diffusion matrix.

FIG. 31 shows a diffusion matrix in a second modified example. In this diffusion matrix, 0 or a negative value is set to the weight applied to each pixel that is expected to have the dot recording state coincident with that of the pixel of interest. When this diffusion matrix is applied, there is a high possibility that the pixels having positive weights have the dot recording state opposite to that of the pixel of interest. There is a high possibility that the pixels having zero or negative weights have the dot recording state coincident with that of the pixel of interest.

FIG. 32 shows a diffusion matrix in a third modified example. In this diffusion matrix, the elements having the weight of 0 occupy approximately 25% of the whole area. This diffusion matrix is used for error diffusion suitable for the test pattern having the dot recording rate of about 25%. Such error diffusion is effective for printing media having a low limit of ink duty.

FIG. 33 shows a diffusion matrix in a fourth modified example. There are a diversity of other diffusion matrixes applicable for the same purpose, for example, a setting in which the middle of three consecutive elements in the main scanning direction shows either the maximum value or the minimum value.

Any of these matrices is applicable to make the areas having high densities of the forward dot and the areas having high densities of the backward dot mixed in both the main scanning direction and the sub-scanning direction. In the resulting printed test pattern, the positional misalignment of dots is readily recognizable.

The size of the diffusion matrix affects the areas that are under the influence of error diffusion. An increase in size of the diffusion matrix accordingly enlarges the areas having high densities of either the backward dot or the forward dot.

The procedure of this embodiment generates the test pattern data by taking into account the above concept. The test pattern data may be generated in advance or at the time of printing the test pattern.

Figure 34:
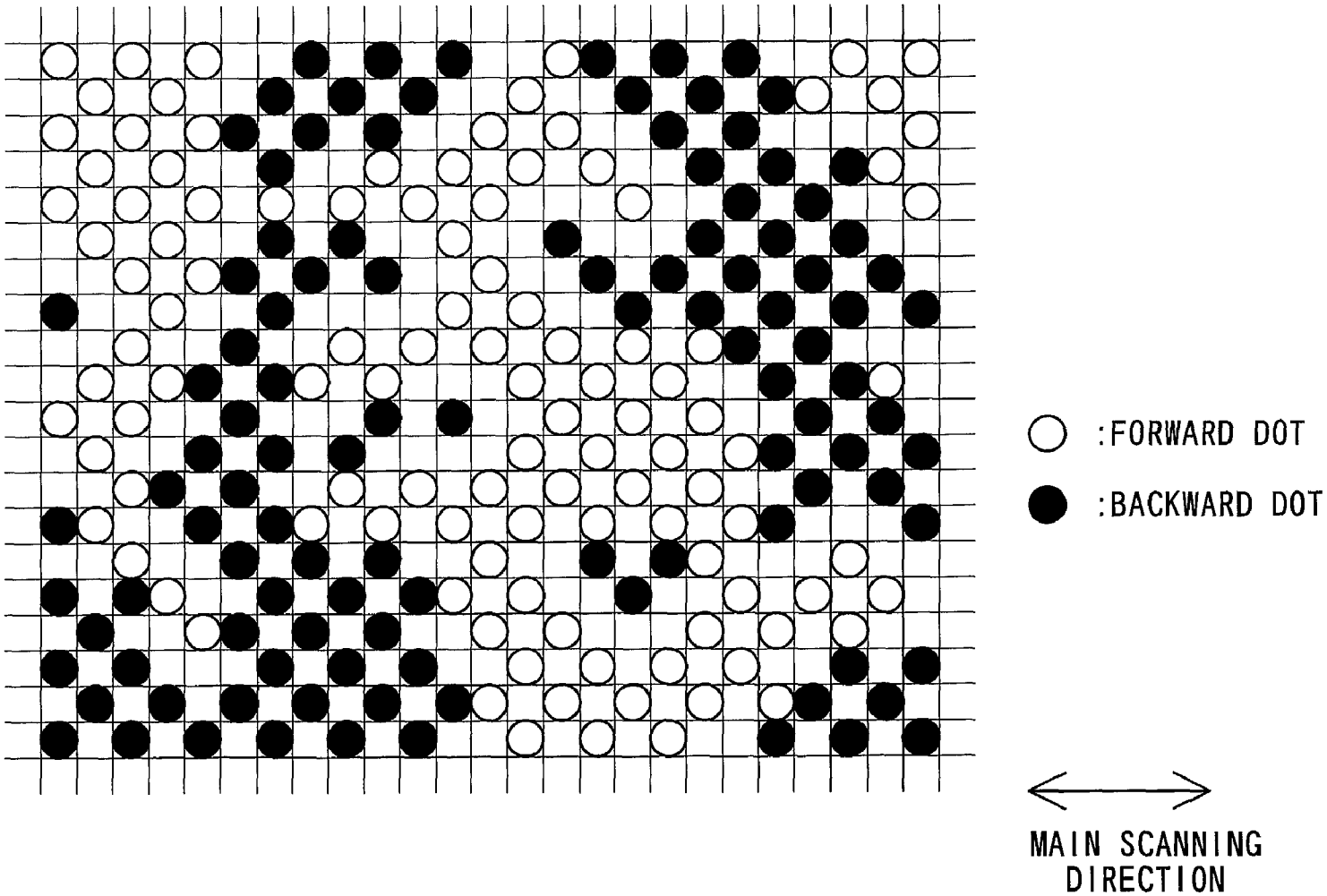
FIG. 34 illustrates a test pattern used in a second embodiment.

FIG. 34 illustrates a test pattern used in the second embodiment. The open circle represents the forward dot, and the closed circle represents the backward dot. In the recording method of this embodiment, pixels with the forward dots and pixels with the backward dots are arranged checkerwise. The dot on-off state in each pixel is thus unequivocally mapped to either the forward dot or the backward dot. As illustrated, in the test pattern of the second embodiment, the areas having high densities of the forward dot and the areas having high densities of the backward dot are mixed in the main scanning direction and in the sub-scanning direction. Such arrangement makes the positional misalignment of dots readily recognizable. It is desirable that these areas appear iteratively at a fixed cycle in at least one of the main scanning direction and the sub-scanning direction. It is also desirable that the respective areas have a substantially equal size.

B2. Adjustment of Drive Timing

Figure 35:
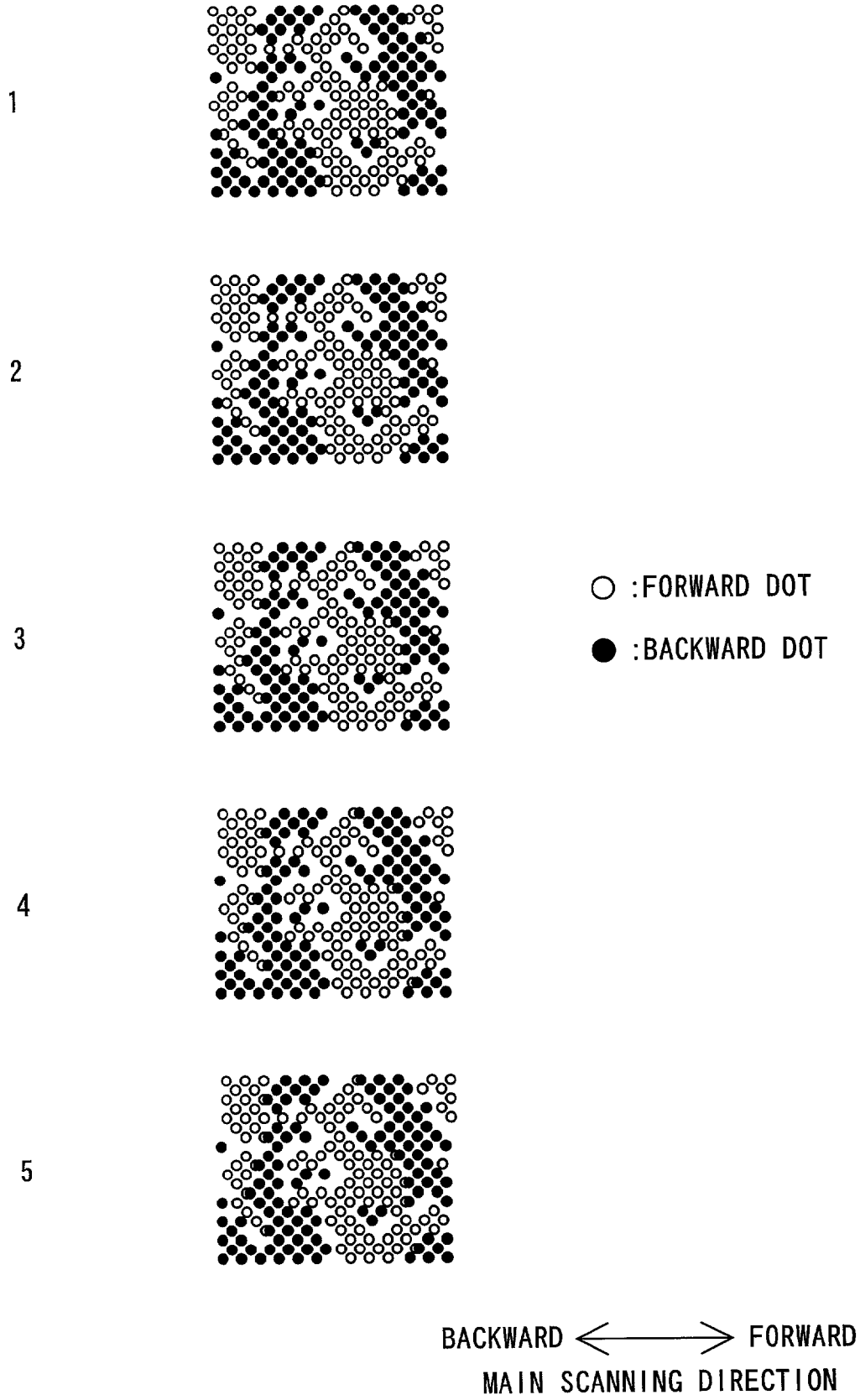
FIG. 35 shows test patterns printed for adjustment of the drive timing in the second embodiment.

FIG. 35 shows test patterns printed for adjustment of the drive timing in the second embodiment. The forward dot and the backward dot have an identical size and an identical color. In the same manner as the first embodiment, the test pattern is recorded by varying the drive timing of the backward dot relative to the drive timing of the forward dot by five different stages.

In the test pattern 1, since the drive timing is earlier than the optimum state, the backward dots are deviated rightward from the forward dots. In the test pattern 2, the backward dots are recorded at adequate positions. In the test patterns 3, 4, and 5, the drive timings are behind the optimum state, so that the backward dots are deviated leftward from the forward dots. The user selects the test pattern '2' having the least rough touch among these five test patterns, and the drive timing is adjusted in the same manner as the first embodiment.

Like the first embodiment, the printing system of the second embodiment discussed above utilizes the test pattern that makes the positional misalignment of dots readily recognizable, thus enabling the drive timing to be adjusted with high accuracy. The suitable recording method is selected according to the print mode. This arrangement ensures adequate printing in each print mode.

B3. Modified Example (1)

In the second embodiment, in order to make the rough touch of the test pattern explicitly recognizable, it is preferable that the areas having high densities of the forward dot and the areas having high densities of the backward dot appear in a spatial frequency domain that gives the high visual sensitivity.

Figure 36:
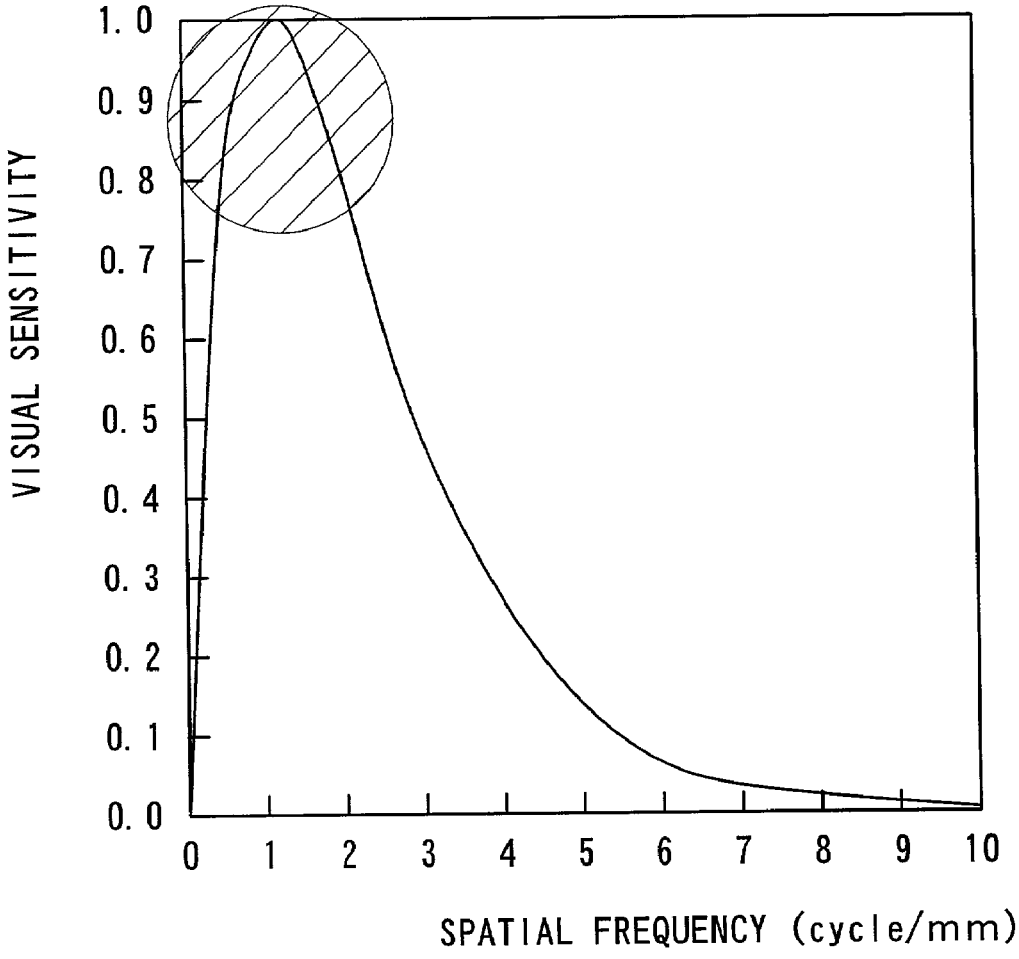
FIG. 36 shows the relationship between the visual sensitivity and the spatial frequency.

FIG. 36 shows the relationship between the visual sensitivity and the spatial frequency. For example, in the case of printing the test pattern at a resolution of 720 dpi, it is preferable that the areas having high densities of either the forward dot or the backward dot have a width of 10 to 50 dots. This corresponds to the spatial frequency of approximately 0.5 to 2.0 [cycle/mm] and gives the high visual sensitivity. Such size is attained according to the suitable setting of the diffusion matrix. Strict adjustment to this frequency domain is, however, not required, but the setting that attains a frequency zone close to this frequency domain is sufficient.

B4. Modified Example (2)

The second embodiment regards the halftoning process by the error diffusion method. The dither method may be applied for the halftoning process. In this case, the process utilizes a dither matrix in which either one of the forward dot or the backward dot is localized. This dither matrix may be inverted for use.

Figure 37:
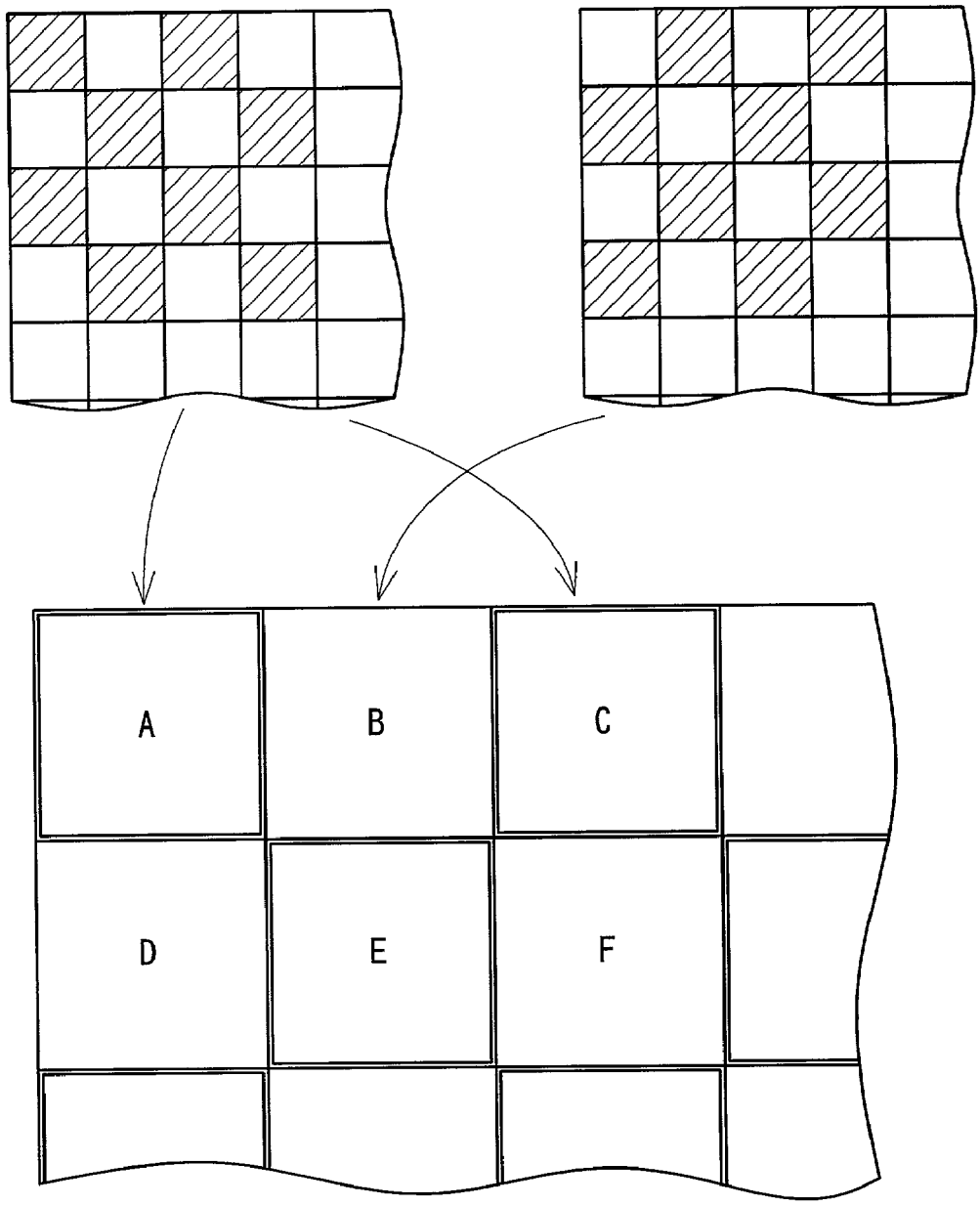
FIG. 37 shows a process of using an inverted dither matrix.

FIG. 37 shows a process of using an inverted dither matrix. The upper left drawing shows a reference dither matrix. This reference dither matrix is set to attain a higher possibility of dot formation in odd-number pixels on odd-number raster lines and even-number pixels on even-number raster lines (that is, the hatched pixels in the drawing). The upper right drawing shows an inversion matrix set by left-to-right inversion of the reference dither matrix. In the inversion matrix, there is a higher possibility of dot formation in even-number pixels on odd-number raster lines and odd-number pixels on even-number raster lines (that is, the hatched pixels in the drawing). The reference dither matrix is applied for areas A, C, and E surrounded by double lines, whereas the inversion matrix is applied for areas B, D, and F. In the case of application of the recording method that arranges the forward dots and the backward dots checkerwise, the areas A, C, and E have higher densities of the forward dot, and the areas B, D, and F have higher densities of the backward dot.

The test pattern of this embodiment may be obtained by the dither method as discussed above. Although the reference matrix and the inversion matrix are arranged in a regular manner in the example of FIG. 37, the regular arrangement is not essential.

B5. Modified Example (3)

Figure 38:
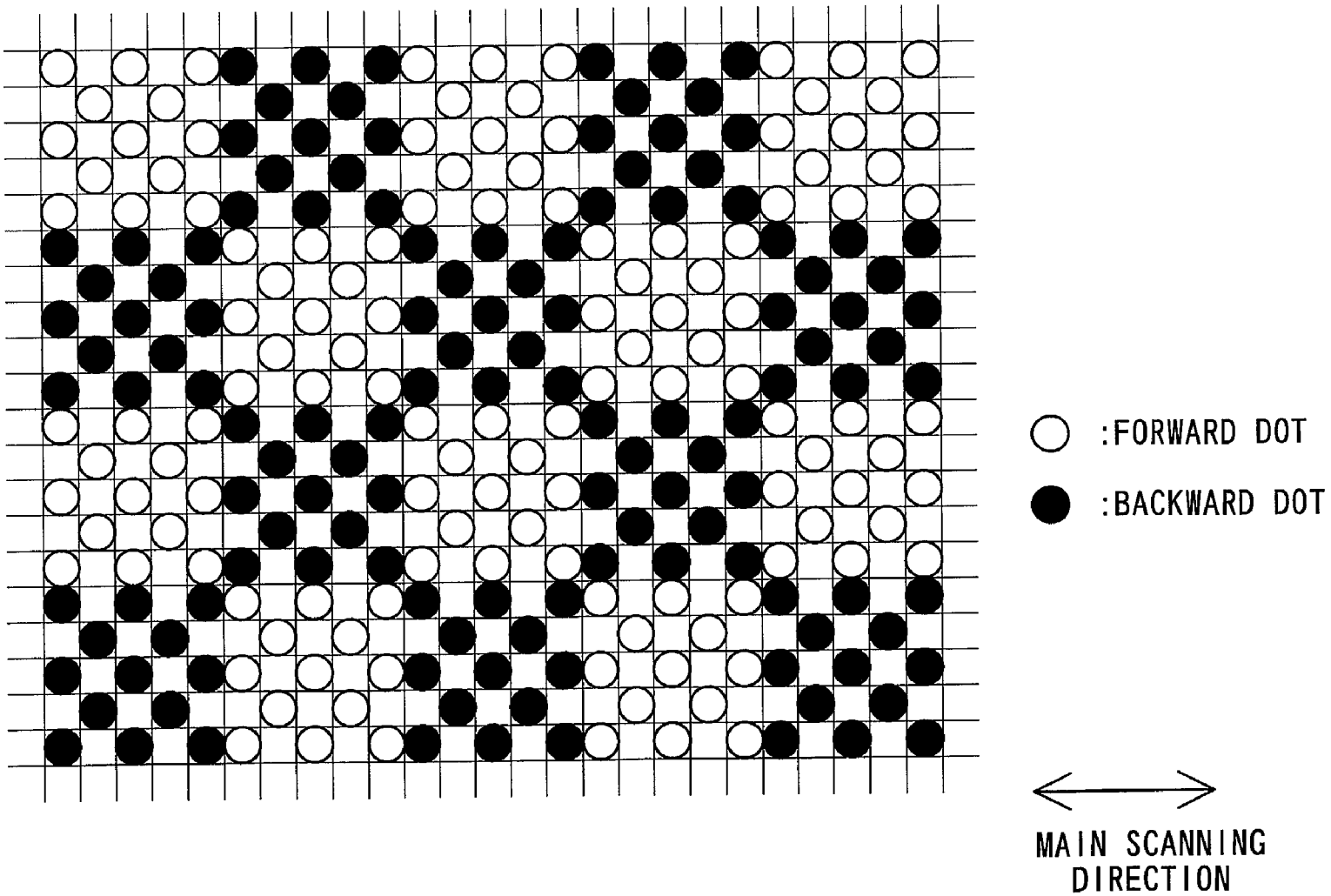
FIG. 38 shows a test pattern in one modified example.

The second embodiment utilizes the test pattern, in which the areas having high densities of the forward dot and the areas having high densities of the backward dot are arranged in an irregular manner. This test pattern may be replaced, for example, with a test pattern including these areas arranged in a regular manner as shown in FIG. 38.

C. Modifications

There are various modifications with regard to the first embodiment and the second embodiment discussed above.

C1. Modified Example (1)

The test pattern is not restricted to printing with only one color ink, but the respective dots may be created with a plurality of different color inks.

Figure 39:
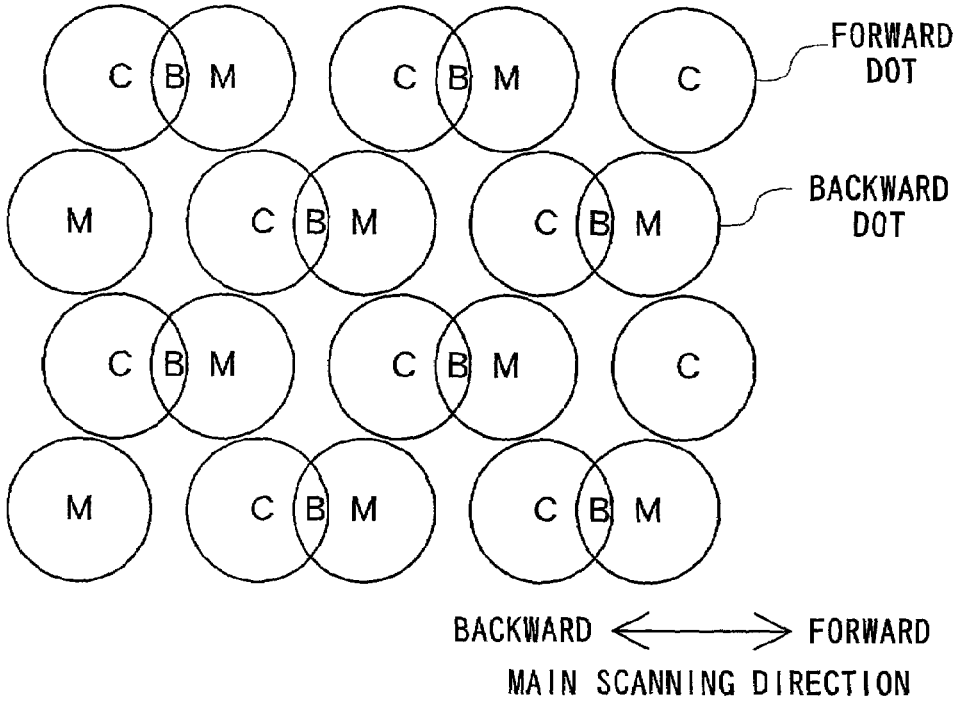
FIG. 39 shows a test pattern in another modified example.

For example, the forward dots and the backward dots in the test pattern may be created with different inks. FIG. 39 shows a test pattern in a modified example. In the example of FIG. 39, the forward dots are formed in cyan (C), and the backward dots are formed in magenta (M).

Since the hue of the forward dots is different from the hue of the backward dots, the overlapped portion has another hue different from these two hues. In the example of FIG. 39, the overlapped portion of cyan and magenta is blue (B). The different hues of the forward dot and the backward dot cause the positional misalignment of dots to affect a variation in hue and make the rough touch more conspicuous. The dot recording positions can thus be adjusted with high accuracy.

Figure 40:
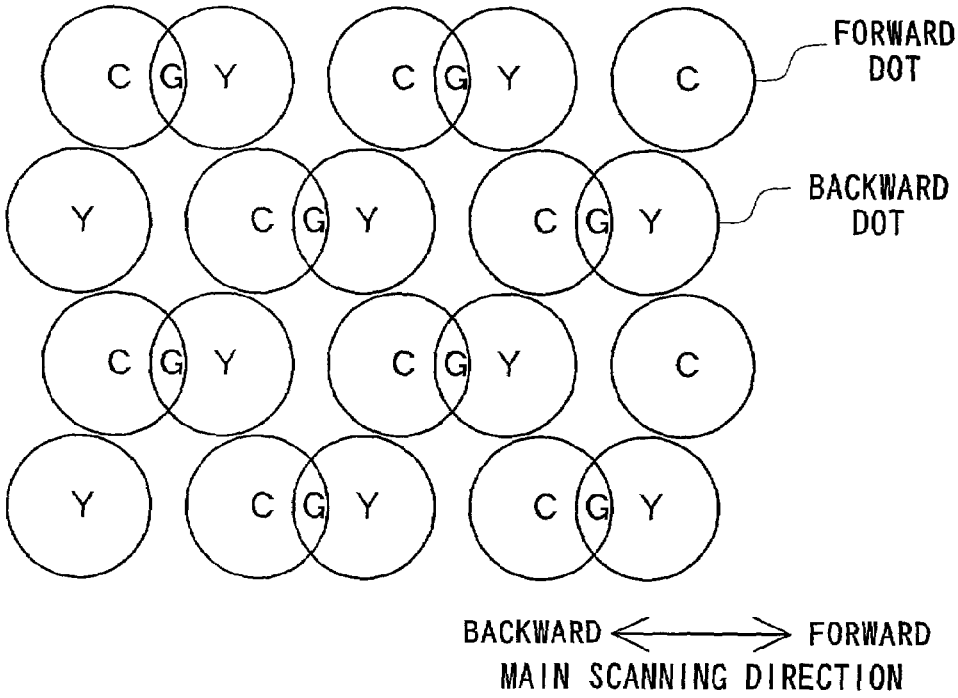
FIG. 40 shows an example of selecting other hues in the test pattern.

The hues of the forward dot and the backward dot may be selected arbitrarily. FIG. 40 shows an example of selecting other hues in the test pattern. The forward dots are formed in cyan (C), and the backward dots are formed in yellow (Y). The overlapped portion is green. Yellow ink has low visual conspicuousness and accordingly has difficulty in adjustment of the dot recording positions. Combination with another hue facilitates the adjustment of the yellow dots.

This modified example uses the total of two colors for the forward dot and the backward dot. Three or more different color inks may be adopted instead.

Figure 41:
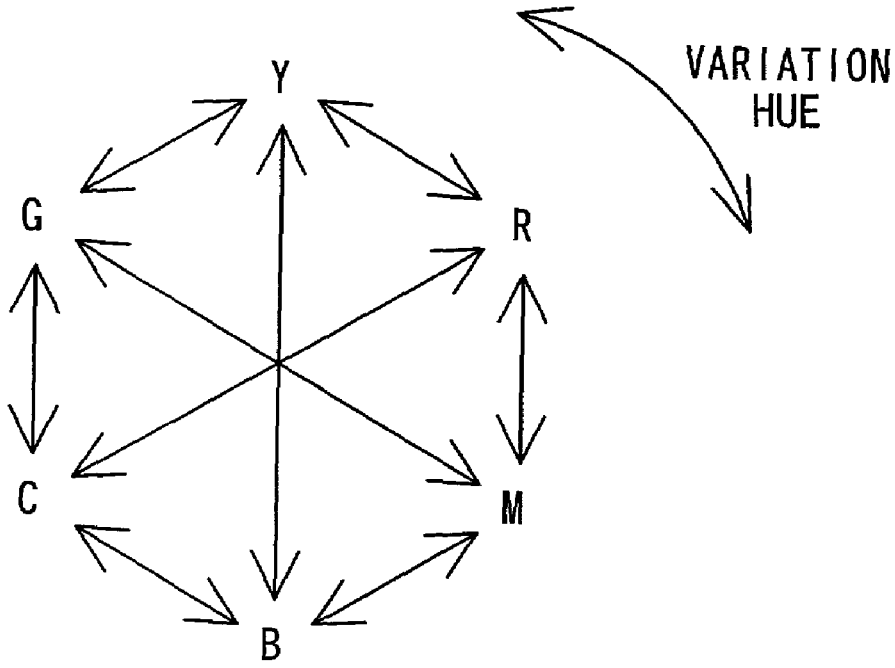
FIG. 41 shows an a*b* plane in an L*a*b* space.

FIG. 41 shows an a*b* plane in an L*a*b* space. This chart shows that mixture of cyan (C) and magenta (M) is blue (B), mixture of magenta (M) and yellow (Y) is red (R), and mixture of yellow (Y) and cyan (C) is green (G). This chart also shows that cyan (C) and red (R), magenta (M) and green (G), and yellow (Y) and blue (B) are complementary colors.

As shown in FIG. 41, using the three or more different color inks enhances a variation in hue in the test pattern. For example, mixing cyan (C) with magenta (M) does not give red (R) or green (G). Application of the third color, yellow (Y), actualizes red (R) and green (G). The greater variation in hue emphasizes the rough touch due to the positional misalignment of dots. The three colors are not restricted to cyan, magenta, and yellow, but may include light cyan ink or light magenta ink having relatively lower visual conspicuousness.

A diversity of arrangements may be applied for the three colors (Ik1, Ik2, and Ik3). For example, either one of the forward dot and the backward dot is formed with two colors (Ik1 and Ik2), and the other dot is formed with the remaining one color (Ik3). In another example, both the forward dot and the backward dot are formed with different combinations of two colors, which include one common color. Namely the forward dot is formed with Ik1 and Ik2 and the backward dot is formed with Ik3.

Figure 42:
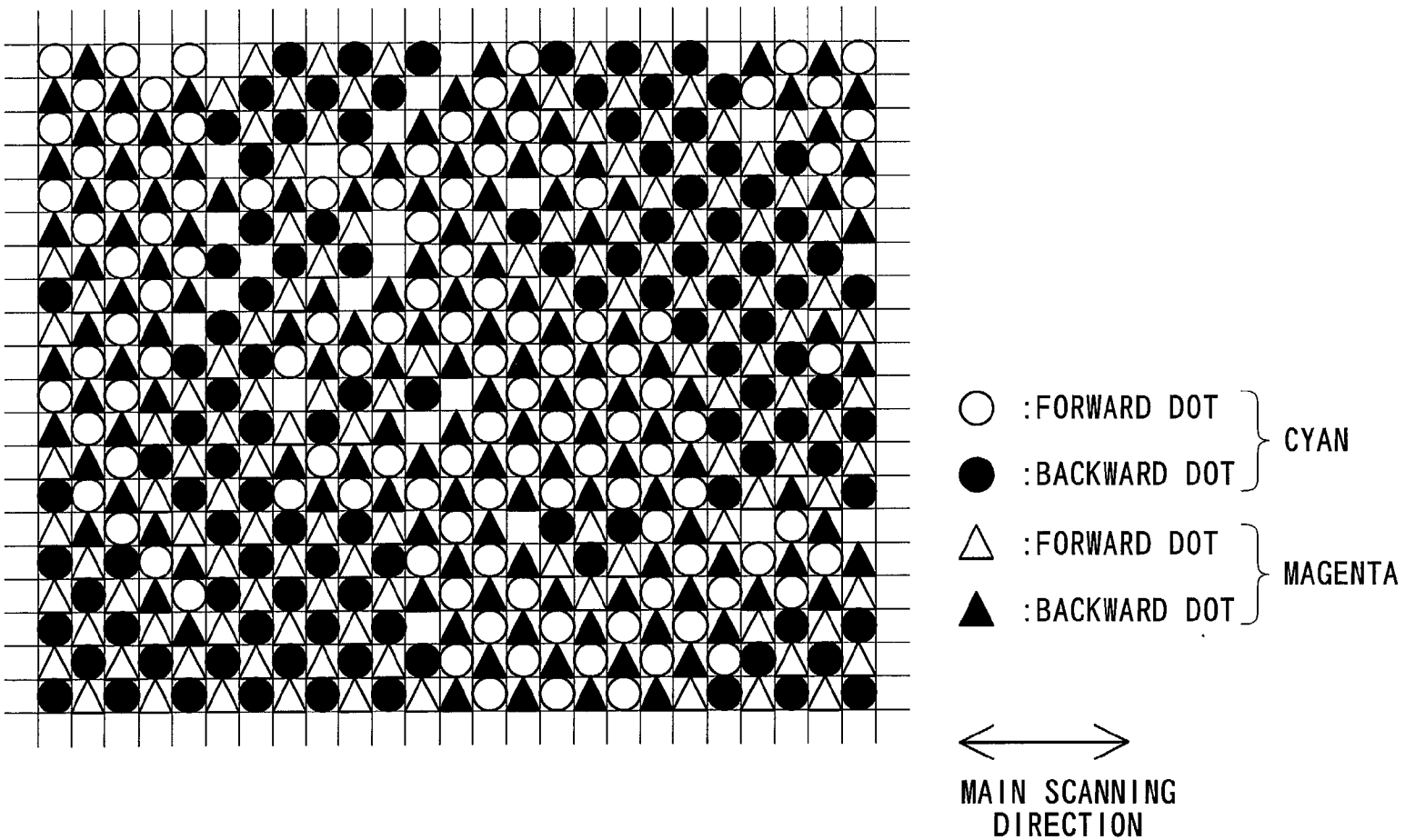
FIG. 42 shows the test pattern of the second embodiment formed in cyan and magenta.

FIG. 42 shows the test pattern of the second embodiment formed in cyan and magenta. In the drawing, the open circle and the closed circle respectively represent the cyan forward dot and the cyan backward dot formed with the cyan ink. The open triangle and the closed triangle respectively represent the magenta forward dot and the magenta backward dot formed with the magenta ink. In this test pattern, the areas having high density of one of the cyan forward dot, the cyan backward dot, the magenta forward dot, and the magenta backward dot are mixed in the main scanning direction and in the sub-scanning direction.

This test pattern is visually recognized as a homogeneous blue patch, in the case where there is no positional misalignment of dots. The positional misalignment makes significant color unevenness. This arrangement thus enables the positional misalignment of dot recording positions to be readily observed.

C2. Modified Example (2)

The procedure of the above embodiment adjusts the relative misalignment of recording positions of the forward dot and the backward dot in bidirectional printing. In general, the technique of the present invention is applicable to adjust the positional misalignment of two different types of dots formed at different timings. The two different types of dots may be dots formed by different nozzle lines in a print head having multiple nozzle arrays of the different positions in the main scanning direction. For example, in the print head 28 shown in FIG. 3, the procedure is applicable to adjust the dot recording positions with inks ejected from the nozzles in the nozzle line A and the nozzle line B in the nozzle array for black ink. The procedure is also applicable to adjust the dot recording positions with inks ejected from the nozzles in the nozzle line B and the nozzle line C, which eject inks of different hues. The technique of the present invention may also be applied to unidirectional printing, in which dots are printed in only the forward pass of the main scan.

Figure 43:
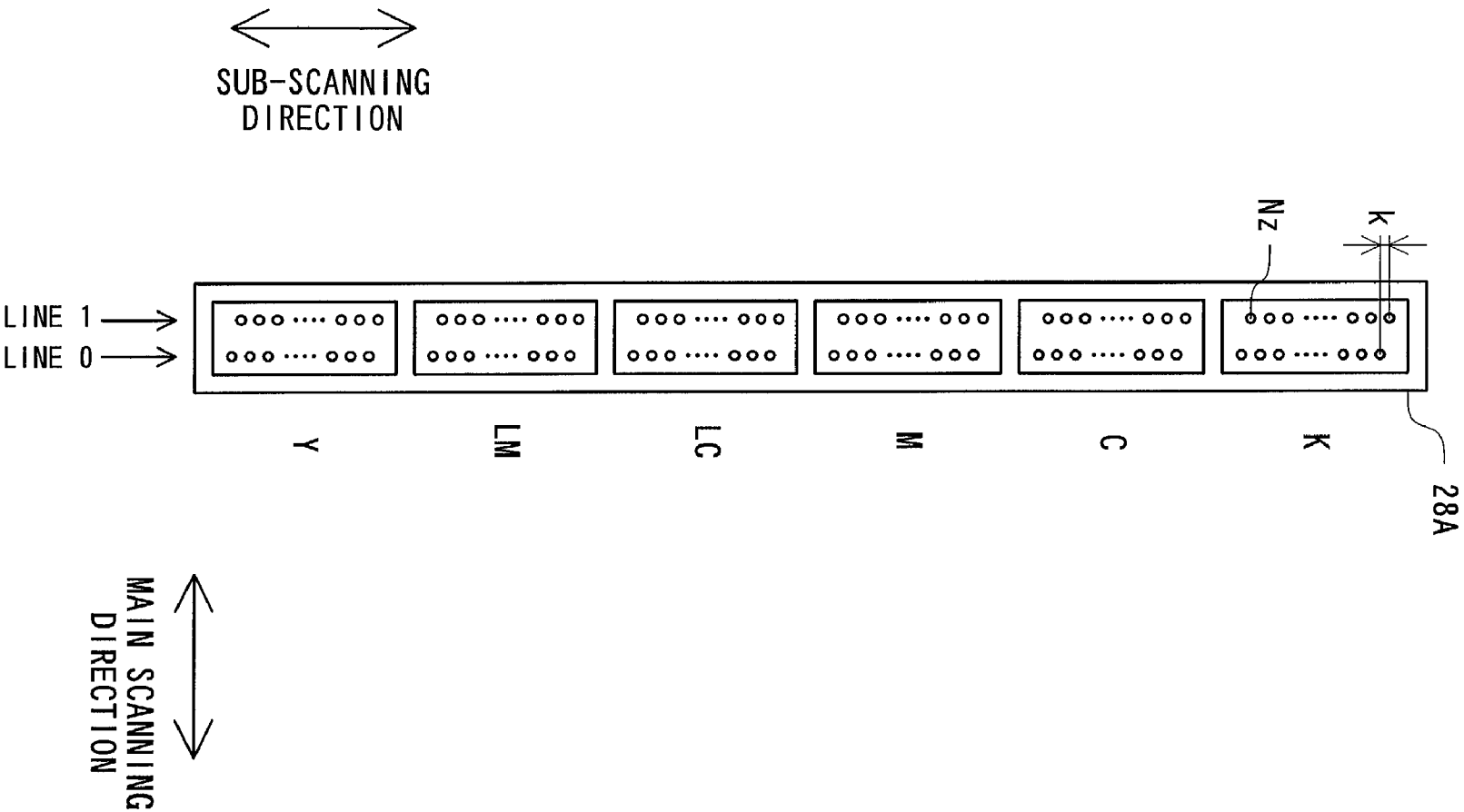
FIG. 43 shows another print head 28A, in which nozzle arrays for ejecting six different color inks are aligned in the sub-scanning direction.

FIG. 43 shows another print head 28A, in which nozzle arrays for ejecting six different color inks are aligned in the sub-scanning direction. The technique of the present invention is applicable to this print head. The technique is applied to adjust the dot recording positions with inks ejected from the nozzles in the nozzle line '0' and the nozzle line '1' in each nozzle array. The technique is also applied to adjust the dot recording positions with inks ejected from the nozzles in different nozzle arrays, which eject inks of different hues.

Figure 44:
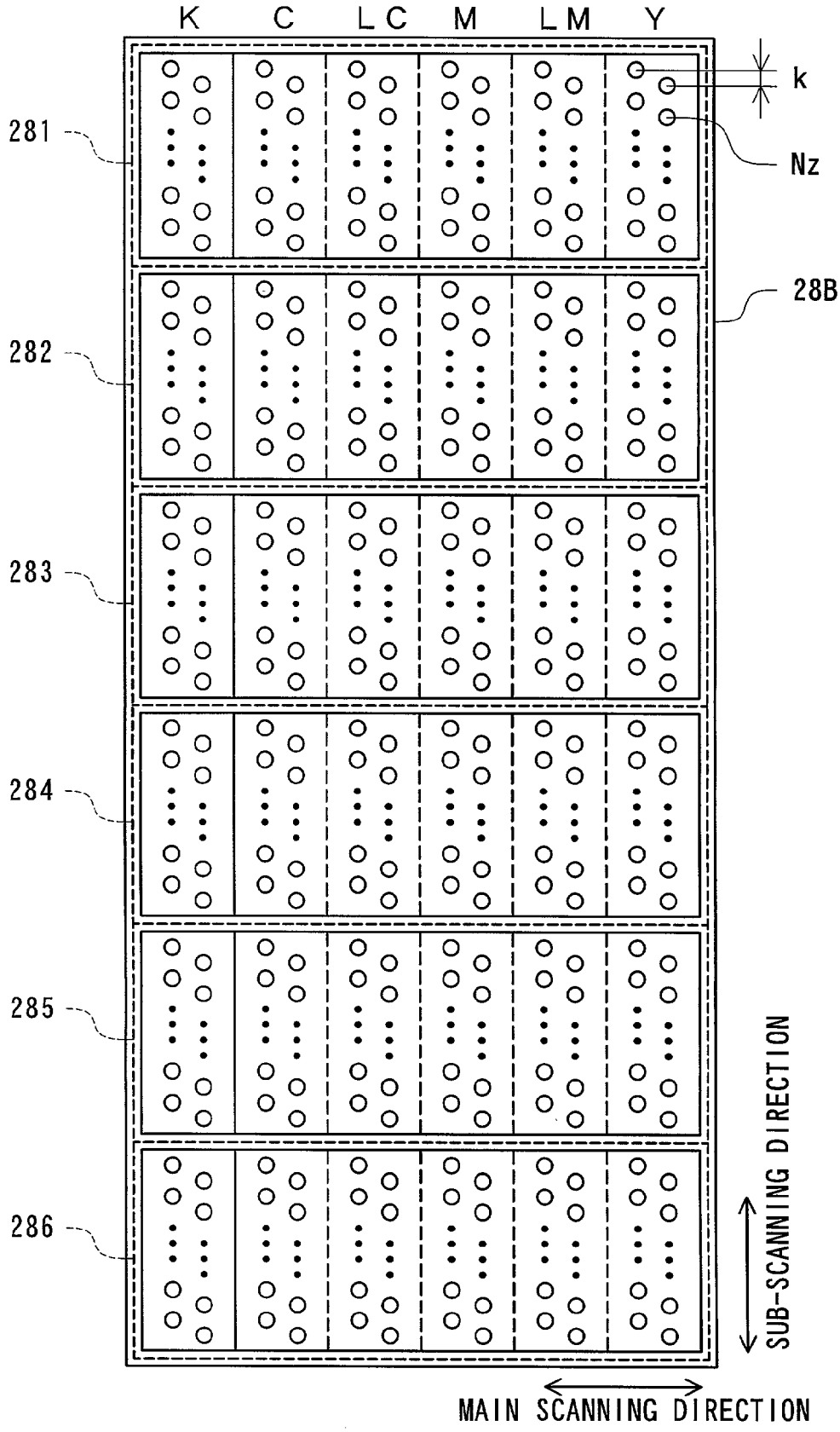
FIG. 44 shows a print head assembly 28B, in which six print heads 28 shown in FIG. 3 are aligned in the sub-scanning direction.

FIG. 44 shows a print head assembly 28B, in which six print heads 28 shown in FIG. 3 are aligned in the sub-scanning direction. The technique of the present invention is also applicable to this print head assembly. The present invention may be applied to any print head assembly including a greater number of nozzle arrays.

C3. Modified Example (3)

The test pattern of the present invention may be used to adjust the positional misalignment in the sub-scanning direction. The dot recording positions may be deviated in the sub-scanning direction, due to mechanical vibrations of the print head during the main scan and give the rough touch to the resulting printed image. The degree of misalignment in the sub-scanning direction is affected by the initial acceleration of the print head in each pass of the main scan. In such cases, the test pattern of the present invention may be utilized to adjust the initial acceleration of the print head in the main scan to the optimum acceleration giving the least rough touch.

C4. Modified Example (4)

The procedure of the embodiment adjusts the relative misalignment of dot recording positions with regard to one identical dot. The procedure may be applied for a plurality of different dots. The modified procedure prints test patterns with regard to the plurality of different dots, selects an optimum test pattern for each dot, and regulates the drive timing of the print head based on the selected test patterns. This ensures the adjustment with higher accuracy. Different test patterns may be used for the plurality of different dots.

Figure 45:
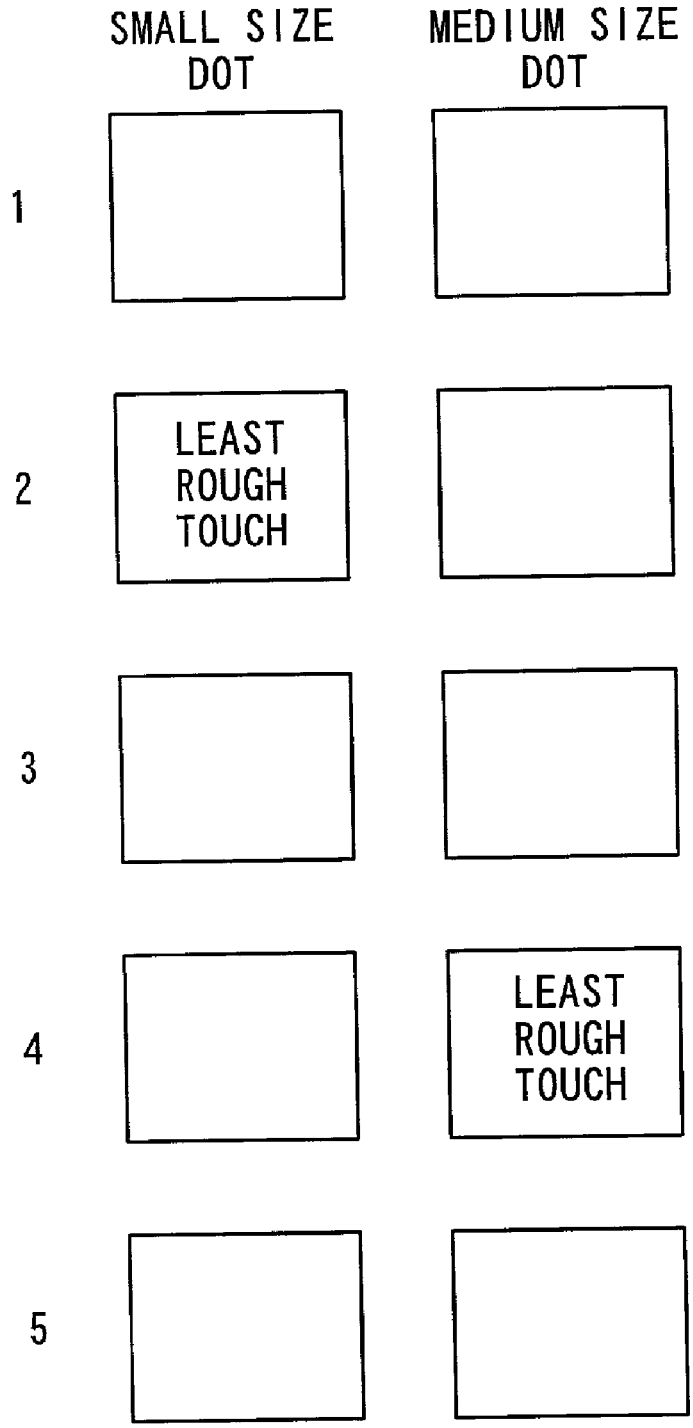
FIG. 45 shows a process of printing test patterns with regard to a small size dot and a medium size dot.
Figure 46:
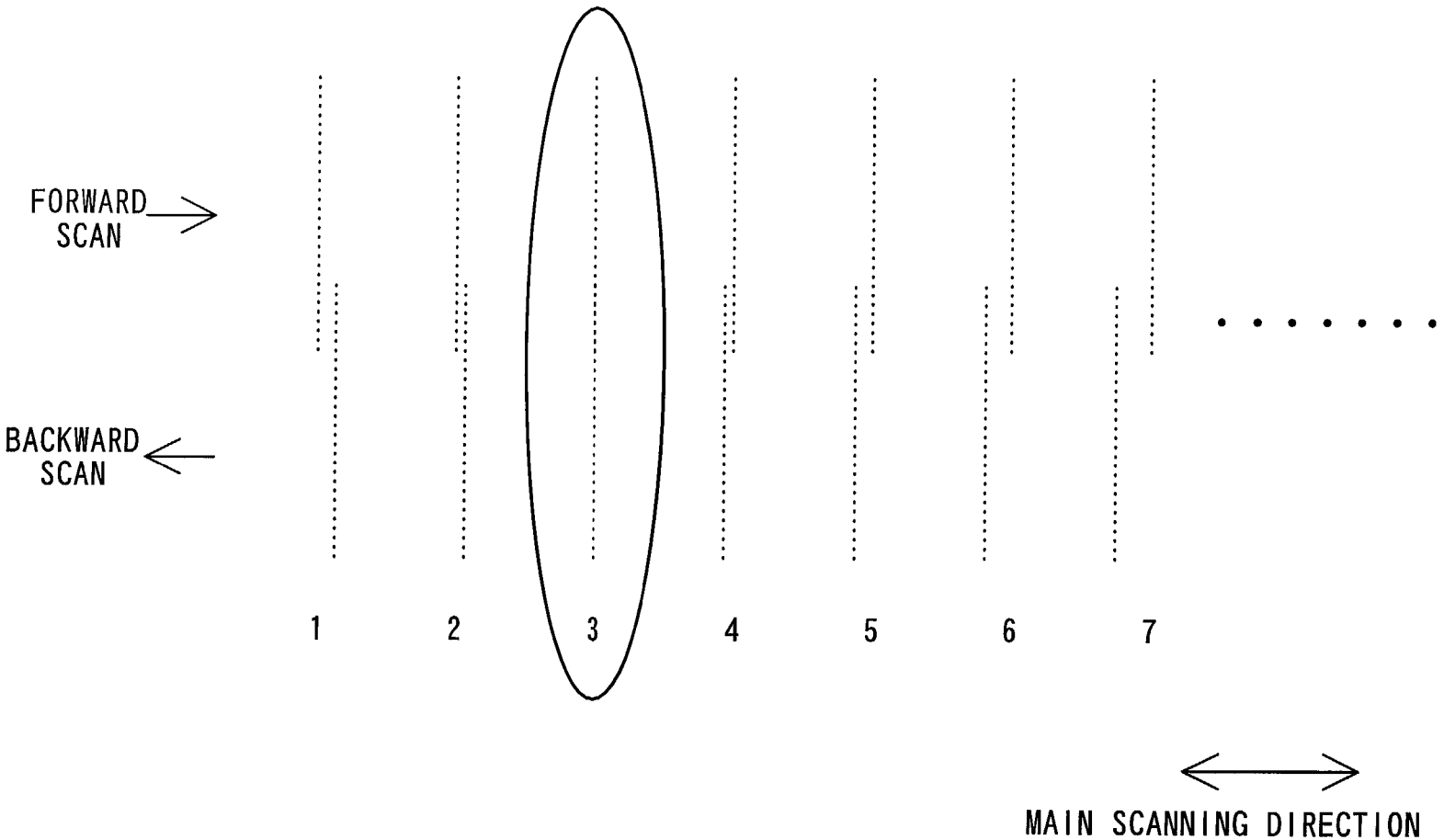
FIG. 46 shows a prior art test pattern.

FIG. 45 shows a process of printing test patterns with regard to a small size dot and a medium size dot. The user selects optimum test patterns of the least rough touch respectively among five test patterns with regard to the small size dot and among five test patterns with regard to the medium size dot and regulates the drive timing based on the selected test patterns. In the illustrated example, the test pattern No. 2 has the least rough touch with regard to the small size dot, and the test pattern No. 4 has the least rough touch with regard to the medium size dot. The drive timing may be adjusted to the timing of printing the third test pattern as the mean of the two optimum test patterns.

The adjustment may be carried out with regard to all the available dots or with regard to only specific dots that significantly affect the printing quality. Another modification detects the working dots based on video data to be printed and carries out the adjustment with regard to only the frequently used dots.

The adjustment with regard to the plurality of different dots may select drive timings of the print head in the respective optimum patterns (hereinafter referred to as the optimum timings) and average the selected optimum timings to determine the mean optimum timing.

Another possible procedure sets the optimum timing of dot formation that most significantly affects the printing quality among the plurality of selected optimum timings. Still another possible procedure sets the most frequent optimum timing among the plurality of selected optimum timings. In the case where the plurality of selected optimum timings have a significant variation, the procedure may add predetermined weights to the respective optimum timings and set an intermediate timing.

C5. Modified Example (5)

Multiple test patterns may be selectively used according to the type of the printing medium and the printing conditions that affect the printing quality, for example, the printing environment. For example, the procedure of the second embodiment may apply the diffusion matrix of FIG. 30 for special paper selected as the printing medium and the diffusion matrix of FIG. 32 for plain paper. Another possible application uses a common diffusion matrix and changes video data used for recording the test pattern.

C6. Modified Example (6)

The above embodiment uses the patch test pattern to adjust the dot recording positions. This patch test pattern may be used in combination with the conventional line test pattern. One possible application roughly adjusts the dot recording positions with the conventional line test pattern and carries out fine adjustment with the patch test pattern.

C7. Modified Example (7)

The above embodiment regards the ink jet printer with piezoelectric elements. The technique of the present invention is also applicable to printers that eject ink droplets according to other mechanisms. One of such printers supplies power to a heater disposed in each ink conduit and utilizes bubbles produced in the ink conduit to eject ink droplets.

C8. Modified Example (8)

The printing apparatus of the embodiment discussed above includes the series of processing executed by the computer. Other applications accordingly include programs for actualizing the processing and recording media in which data are stored. Typical examples of the recording media include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

INDUSTRIAL APPLICABILITY

The technique of the present invention is applied to enhance the accuracy of adjustment of misalignment of recording positions of dots created at different timings.

The invention claimed is:

1. A print control apparatus that supplies print data to a printing device, which creates dots and thereby carries out printing, said printing device comprising:

a print head having multiple nozzles, from which ink is ejected;

a scanning module that carries out main scan and sub-scan of said print head; and a driving module that drives said print head during each scan and causes at least two different types of dots, a first dot and a second dot, to be created at different timings in respective pixels, said print control apparatus comprising:

a test pattern data generation module that generates test pattern data as the print data used for printing a test pattern, wherein the test pattern data comprises:

a patch pattern which defines a dot placement status of each of the pixels forming an arrangement of substantially equal numbers of first dots and second dots in a first area having a higher density of the first dot than a density of the second dot and in a second area having a higher density of the second dot than a density of the first dot, wherein the first area and the second area have a substantially equivalent size and are mixed in a main scanning direction and in a sub-scanning direction, and timing data;

wherein the driving module drives the print head and the scanning module to print at least one test pattern based on the test pattern data, and wherein the appearance of the printed test pattern varies with a variation of the timing data.

2. A print control apparatus in accordance with claim 1, wherein a recording rate in the test pattern corresponds to an intermediate tone.

3. A print control apparatus in accordance with claim 1, wherein the first dots and the second dots are created with nozzles having different positions in the main scanning direction.

4. A print control apparatus in accordance with claim 1, wherein said driving module drives said print head in both a forward pass and a backward pass of the main scan, the first dots are forward dots created in the forward pass, and the second dots are backward dots created in the backward pass.

5. A print control apparatus in accordance with claim 1, wherein said print head is capable of ejecting multiple inks of different hues, and the printed test pattern includes the first dots and the second dots, which are created with inks of different hues.

6. A print control apparatus in accordance with claim 1, wherein said print head is capable of ejecting multiple inks of different hues, said driving module drives said print head in both a forward pass and a backward pass of the main scan, the first dots are forward dots created in the forward pass of the main scan of said print head, the second dots are backward dots created in the backward pass of the main scan of said print head, and the test pattern includes the forward dots and the backward dots, both of which are created with multiple color inks.

7. A print control apparatus in accordance with claim 1, wherein a spatial frequency of appearance of the first area and the second area in the main scanning direction ranges 0.4 to 2.0 cycles/mm.

8. A print control apparatus in accordance with claim 1, said print control apparatus further comprising:

a printing condition input module that inputs a printing condition, wherein said test pattern data generation module generates different test pattern data according to the input printing condition.

9. A print control apparatus in accordance with claim 1, wherein said test pattern data generation module comprises:

a memory that stores tone data of the test pattern; and a print data generation module that causes the tone data to be subjected to a halftoning process with a diffusion matrix, which diffuses a tone error arising in a pixel of interest currently processed to peripheral non-processed pixels with preset weights, and thereby generates print data used for printing the test pattern.

10. A print control apparatus in accordance with claim 9, wherein the diffusion matrix sets a greatest value to elements corresponding to non-processed pixels adjoining to the pixel of interest in the main scanning direction and in the sub-scanning direction.

11. A print control apparatus in accordance with claim 9, wherein the diffusion matrix sets either of zero and a negative value to an element corresponding to a pixel, which is expected to be in a state of dot formation identical with that in the pixel of interest.

12. A print control apparatus in accordance with claim 9, wherein the diffusion matrix sets either of a maximum value and a minimum value to a middle element among three consecutive elements aligned in the main scanning direction.

13. A recording medium in which a computer program is recorded in a computer readable manner, said computer program controlling a printing device that comprises a print head having multiple nozzles for ejecting ink and creates dots on a printing medium with said print head, said computer program causing a computer to actualize functions of a print control apparatus in accordance with any one of claims 1 to 12.

14. A recording medium in which print data is recorded in a computer readable manner, said print data being used to control a printing device that comprises a print head having multiple nozzles for ejecting ink and creates dots on a printing medium with said print head, said print data being used to print a test pattern, which is applied to a print control apparatus in accordance with any one of claims 1 to 12.

15. A recording medium in which a diffusion matrix is recorded in a computer readable manner, said diffusion matrix being used to control a printing device that comprises a print head having multiple nozzles for ejecting ink and creates dots on a printing medium with said print head, said diffusion matrix being used to generate a test pattern, which is applied to a print control apparatus in accordance with any one of claims 10 to 12.

16. A test pattern printed based on test pattern data used to adjust misalignment of recording positions between first dots and second dots created at different timings, wherein the test pattern data comprises:

a patch pattern which defines a dot placement status of each of the pixels forming an arrangement of substantially equal numbers of first dots and second dots in a first area having a higher density of the first dot than a density of the second dot and in a second area having a higher density of the second dot than a density of the first dot, wherein the first area and the second area are mixed in a two-dimensional manner in the patch pattern, and timing data;

wherein the appearance of the printed test pattern varies with a variation of the timing data.

17. A method of adjusting misalignment of recording positions between first dots and second dots, which are created at different timings by a printing device that comprises a print head having multiple nozzles for ejecting ink and creates dots on a printing medium with said print head, said method comprising the steps of:

(a) driving said print head at a plurality of preset different timings and thereby printing a plurality of test patterns based on test pattern data to allow detection of the misalignment of recording positions between the first dots and the second dots;

(b) selecting an optimum test pattern among the plurality of printed test patterns; and (c) setting a drive timing of said print head corresponding to the selected test pattern, wherein said test pattern data comprises:

a patch pattern which defines a dot placement status of each of the pixels forming an arrangement of substantially equal numbers of the first dots and the second dots in a first area having a higher density of the first dot than a density of the second dot and in a second area having a higher density of the second dot than a density of the first dot, wherein the first area and the second area are mixed in a main scanning direction and in a sub-scanning direction, and the preset timing.

18. A method in accordance with claim 17, wherein said print device is capable of creating N different types of dots (where N is an integer of not less than 2), said step (a) comprises the step of printing the test patterns with regard to M different types of dots (where M is an integer of not less than 2 and not greater than N) among the N different types of dots, said step (b) comprises the step of selecting the optimum test patterns with regard to the M different types of dots, and said step (c) comprises the step of determining the drive timing of said print head according to a predetermined function based on M drive timings of said print head corresponding to the selected M test patterns.

* * * * *